US007549432B2

(12) United States Patent
Sherts

(10) Patent No.: US 7,549,432 B2
(45) Date of Patent: Jun. 23, 2009

(54) COLLAPSIBLE FRAME SUPPORT FOR FLEXIBLE MATERIAL

(75) Inventor: Charles Sherts, Westport, CT (US)

(73) Assignee: Innex Corporation, Westport, CT (US)

( * ) Notice: Subject to any disclaimer, the term of this patent is extended or adjusted under 35 U.S.C. 154(b) by 95 days.

(21) Appl. No.: 11/452,168

(22) Filed: Jun. 13, 2006

(65) Prior Publication Data

US 2007/0283991 A1 Dec. 13, 2007

(51) Int. Cl.
*E04H 15/44* (2006.01)

(52) U.S. Cl. ..... 135/123; 135/90; 135/127; 135/117

(58) Field of Classification Search ..... 135/90, 135/123, 127–128, 114–115, 117, 119, 120.1, 135/120.2, 120.4, 905, 907, 20.1; 248/230.8, 248/228.8, 160; 24/122.3, 300
See application file for complete search history.

(56) References Cited

U.S. PATENT DOCUMENTS 870,429 A * 11/1907 Grimler ..... 248/160
1,348,145 A * 8/1920 Arden ..... 15/104.165
2,828,758 A * 4/1958 Moro ..... 135/90
4,312,371 A * 1/1982 Koon ..... 135/19.5
4,675,916 A * 6/1987 Orsini ..... 2/181
4,979,531 A * 12/1990 Toor et al. ..... 135/127
5,259,408 A * 11/1993 Guerin ..... 135/90
5,423,341 A * 6/1995 Brady ..... 135/139
5,435,024 A * 7/1995 Capshaw ..... 5/417
5,669,403 A * 9/1997 Belcher et al. ..... 135/90
6,076,539 A * 6/2000 Richardson ..... 135/20.1
6,431,193 B2 * 8/2002 Carter ..... 135/145
6,748,962 B2 * 6/2004 Miller ..... 135/130

* cited by examiner

*Primary Examiner*—Winnie Yip
(74) *Attorney, Agent, or Firm*—Perman & Green LLP

(57) ABSTRACT

A collapsible device including at least one retraction device, at least one collapsible compression frame having compression members, at least one tension member having at least one end connected to the at least one retraction device and running through a channel in each of the compression members and a flexible barrier attached to the at least one compression frame. The barrier having at least one channel through which the at least one compression frame passes.

15 Claims, 29 Drawing Sheets

COLLAPSIBLE FRAME SUPPORT FOR FLEXIBLE MATERIAL

BACKGROUND

1. Field

The present embodiments relate to collapsible devices and, more particularly, to devices having collapsible frames.

2. Brief Description of Related Developments

Conventional protective devices for protection against the elements, such as umbrellas generally have a handle and a support structure for the umbrella canopy that is located on a shaft. The support structure generally consists of many parts designed to unfold from the shaft in an outward and upward direction. The conventional canopy support structure generally includes support ribs that extend radially from a hub located on the shaft, which divide the canopy into several pie shaped sections. Along the outer rim of the canopy, each support rib terminates in a point. This point generally is not covered by anything and may cause injury to the user of the umbrella or a bystander in the vicinity of the user. The points also create a place for electrical charges to build up which may be a potential hazard during an electrical storm. Conventional umbrellas of this type are also subject to blowouts where wind gets under the umbrella and forces the umbrella canopy to turn inside out.

Umbrellas having a circumferential support around the rim of the umbrella are also known. The circumferential ring is generally flexible and may be bent or twisted for storage. However the flexible nature of the ring may cause the umbrella to spring open at an undesirable point in time. These umbrellas only collapse to a smaller ring shape by twisting. In their collapsed state these umbrellas still remain large and too bulky/awkward to easily be carried around in a purse, pocket, briefcase, or knapsack. These umbrellas may or may not have a handle attached to a ring that forms the base or outer rim of the umbrella. These "ring" umbrellas may or my not have a collapsible support structure attached to the ring for giving the canopy of the umbrella a domed shape.

Other devices made to protect a user from the elements are disassembled for storage and have to be reassembled before each use. An example of this would be a transportable beach parasol, which has a shaft that is driven into the ground. The shaft has a pivot attachment on the free end that supports the canopy. The canopy is constructed of several tubular sections that are assembled around and slid through loops in the canopy. Assembly and deployment is complicated, time consuming and has the potential to loose parts. Each tubular section has a receiving end and an insertion end so that when the sections are assembled the insertion end of a section is inserted into the receiving end of another section.

Many protective devices such as umbrellas also have a central support shaft, which obstructs usable space under the canopy. The central support shaft often protrudes above the canopy and is often made of metal making it dangerous in electrical storms.

Conventional umbrellas are also complex and require a large multitude of complex parts. This adds to the cost and complexity of manufacture and creates many weak points that can fail and cause the umbrella to break or malfunction. The multiple linkages and sliding parts of a conventional umbrella are also exposed causing a multiple of "pinch points" which can cause injury to the user when opening or closing.

On a larger scale building structures, such as tents and shelters generally have many parts that need to be assembled before each use. For example, the parts used to construct a tent may include support shafts for the walls and roof. The assembly of the tent is generally time consuming and loose parts may be lost. Because of the complexity of conventional tents and shelters people may not be able to set them up or they may be set up incorrectly causing a dangerous situation resulting in collapse and injury. Shelters may also have many components including various types of roofing components. These roofing components may include trusses or yurts, which in and of themselves include many sub-components requiring time to construct.

It would be advantageous to have a utility device whose concept can be applied to overcome the above deficiencies as well as applied to other protective and utility applications.

SUMMARY

In one exemplary embodiment, a collapsible device is provided. The collapsible device includes at least one retraction device, at least one collapsible compression frame having compression members and at least one tension member. The at least one tension member having at least one end connected to the at least one retraction device and running through a channel in each of the compression members. The collapsible device also includes a flexible barrier attached to the at least one compression frame, the barrier having at least one channel through which the at least one compression frame passes.

In another exemplary embodiment a collapsible device is provided. The collapsible device includes a retraction device, a first collapsible compression frame having compression members, a second collapsible compression frame having compression members, the second compression frame being attached to the first compression frame by a frame support member, at least one tension member having at least one end connected to the retraction device and running through a channel in each of the compression members of the first and second compression frames and a flexible barrier attached to the first and second compression frames, the barrier having at least two channels through which the first and second compression frames pass.

In one exemplary embodiment a collapsible device is provided. The collapsible device includes a hub, a first compression member depending from the hub and a second compression member depending from the hub. The first and second compression members being joined to each other at an end by a hinge device. The collapsible device also includes a tension member running from the hub to the joined ends of the first and second compression members and a flexible barrier attached to the first and second compression members, the barrier having two channels through which the first and second compression members pass wherein a retraction of the tension member causes the first and second compression members to flex and open the barrier so that it is taut between the first and second compression members.

In another exemplary embodiment a collapsible device is provided. The collapsible device includes a handle having a retracting device, a pole support attached at a first end to the handle, a compression frame attached to a second end of the pole support, the compression frame having compression members and a tension member attached to the retraction device and running through the pole support and through channels in the compression members wherein tightening the tension member causes the compression frame to form a rigid frame.

BRIEF DESCRIPTION OF THE DRAWINGS

The foregoing aspects and other features of the present embodiments are explained in the following description, taken in connection with the accompanying drawings, wherein:

FIGS. 32A-G illustrate a compression member in accordance with an exemplary embodiment.

DETAILED DESCRIPTION OF THE EXEMPLARY EMBODIMENT(s)

Figure 1A:
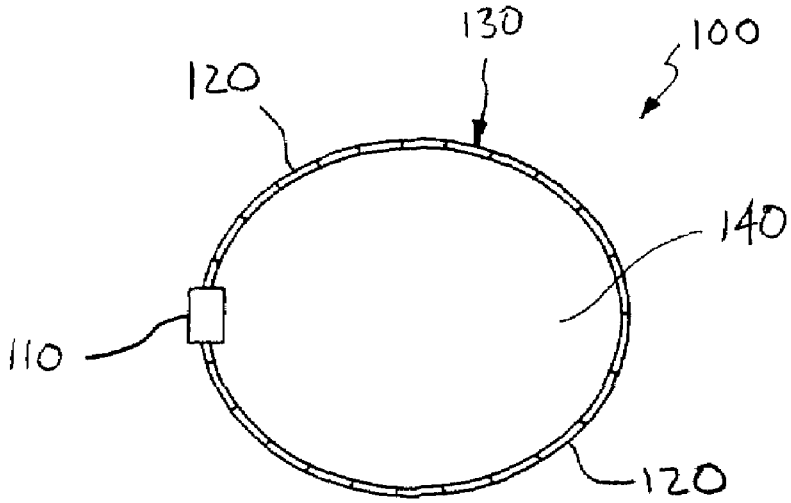
FIGS. 1A-B shows a top and side view of a support structure in accordance with an exemplary embodiment.

FIGS. 1A-B and 2A-B illustrate a top and side view of a support structure 100, 220 incorporating features of an exemplary embodiment. Although the present embodiments will be described with reference to the exemplary embodiments shown in the drawings and described below, it should be understood that the present embodiments could be embodied in many alternate forms of embodiments. In addition, any suitable size, shape or type of elements or materials could be used.

Figure 1B:
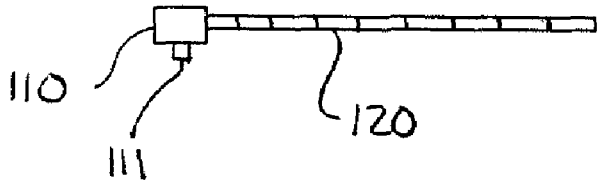
Figure 2A:
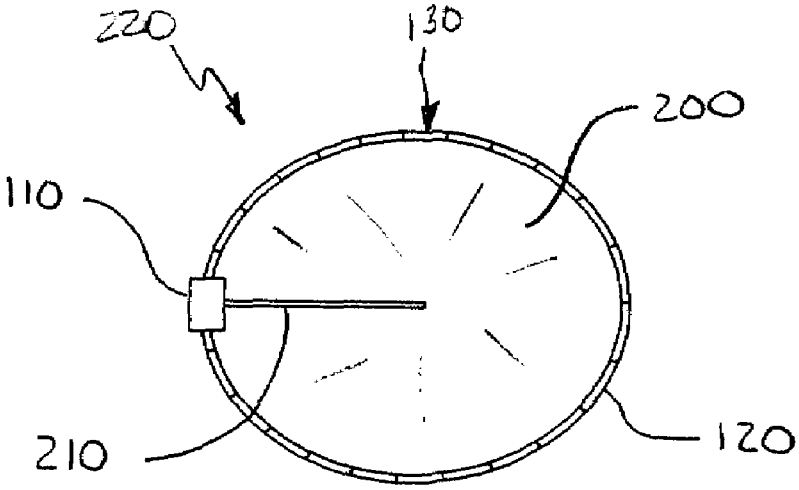
FIGS. 2A-B shows a top and side view of a support structure with a flexible canopy in accordance with an exemplary embodiment.
Figure 2B:
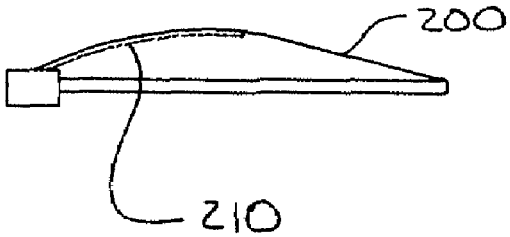

As shown in FIGS. 1A-B the support structure 100 generally includes one or more elongated compression members 120 that form an exterior perimeter support structure or compression frame 130 having a retraction mechanism or tensioner 110. As can be seen in FIGS. 2A-B the support structure 100 may also include a center support assist member or center support 210 and a canopy 140, 200. A tension member 1600 (FIG. 16), a pre-tension elastic member 1610, and a canopy position assist member 1330 (FIG. 13B) may also be included in the support structure.

The compression frame 130 may be of any suitable size and includes two or more compression members 120 strung together with at least one tension member 1600. When the at least one tension member 1600 is tightened the compression members form a rigid frame support for a flexible piece of material, such as for example, canopy 140. When the compression members 120 are in a relaxed or non-tensioned state, the compression frame 130 may, for example, be folded for storage. The compression members 120 may become rigid when they are held together end-to-end in compression. In this example, the compression frame 130 is shown as having an oval shape. In alternate embodiments the compression frame may have any suitable shape such as, for example, circular, octagonal, football shaped, diamond shaped, teardrop shaped or any suitable combination thereof as shown in FIGS. 5A-5F. The compression members 120 can be made of any suitable material such as, for example, plastic, metal, carbon fiber or any other material that resists buckling or radical deformation under compressive loads. The compression members 120 may also have any suitable length and cross-section such as, for example, cross-sections 120A-F and 120H-J as shown in FIGS. 17A-F and 17H-J. The compression members 120 may depend from a retraction mechanism 110 or a hub 610 (FIG. 6) of the compression frame 130 so as to form a type of cantilever.

Figure 17A:
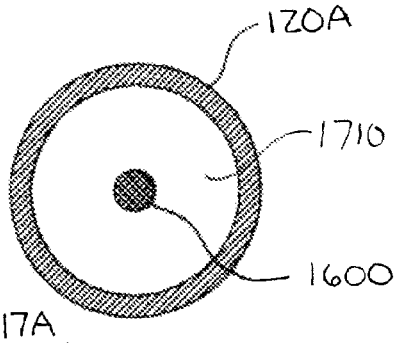
FIGS. 17A-J illustrate cross-sectional views of compression and tension members of a support structure in accordance with an exemplary embodiment.
Figure 17B:
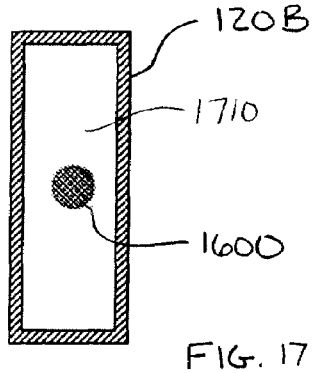
Figure 17C:
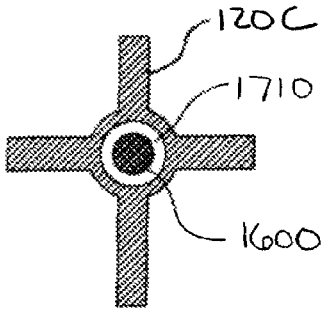
Figure 17D:
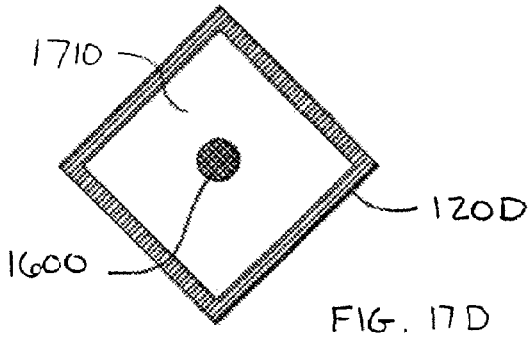
Figure 17E:
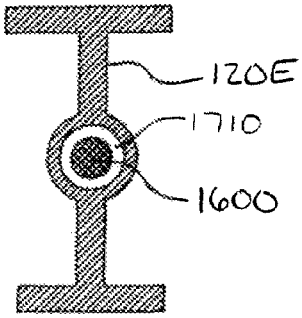
Figure 17F:
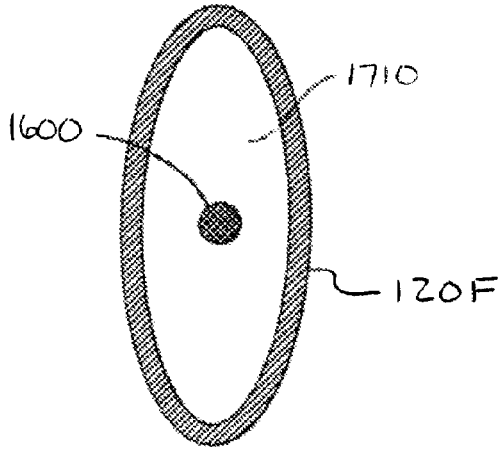
Figure 17J:
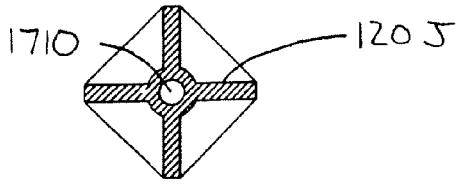
Figure 17G:
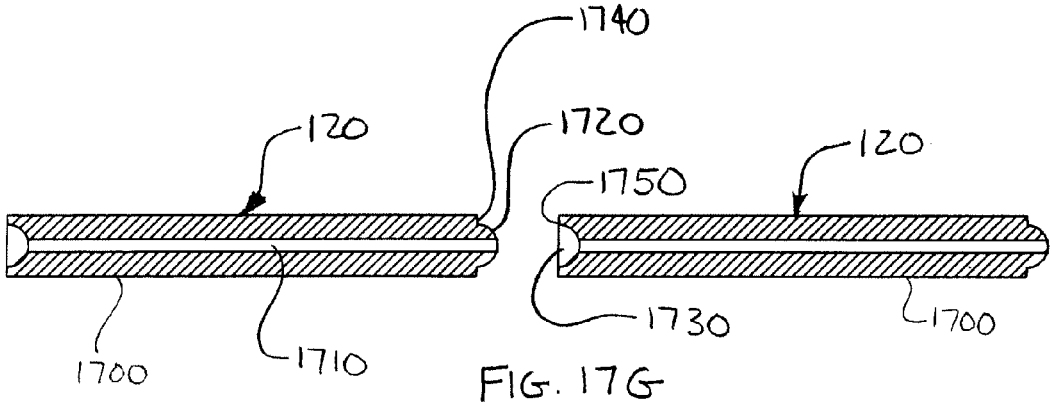
Figure 17H:
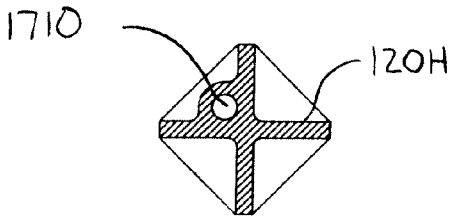
Figure 17I:
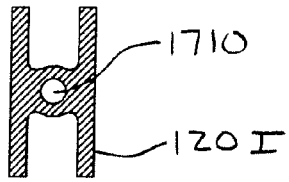
Figure 18A:
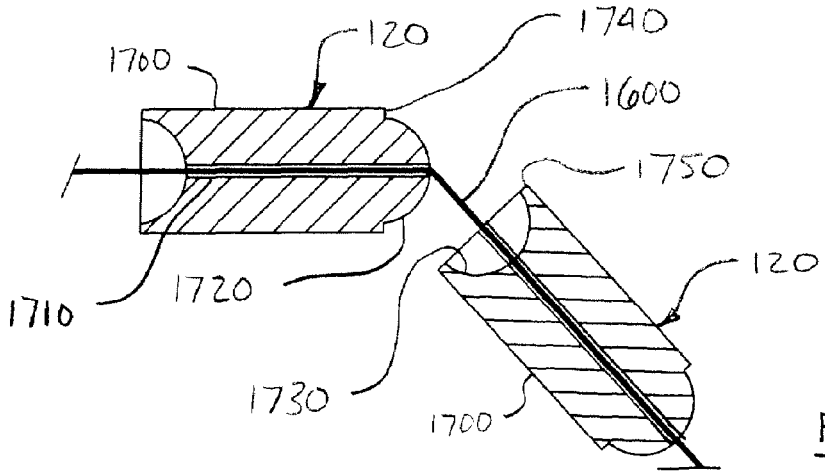
FIGS. 18A-D illustrate a cross-sectional view of an assembly of compression members in accordance with an exemplary embodiment.
Figure 18B:
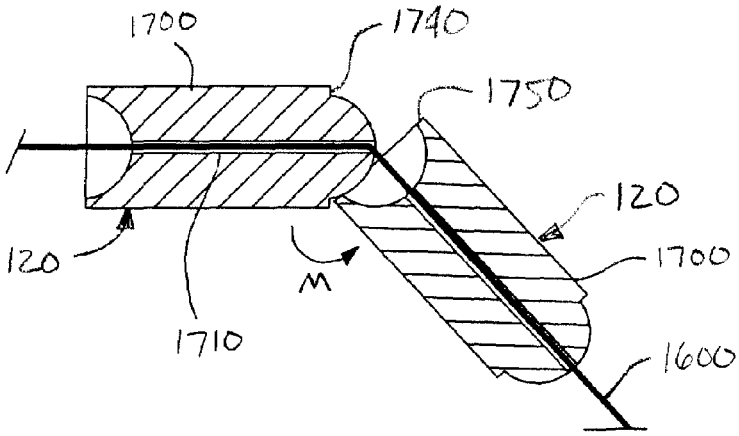
Figure 18C:
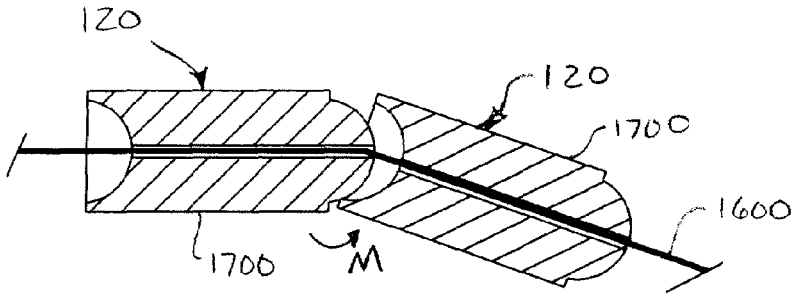
Figure 18D:
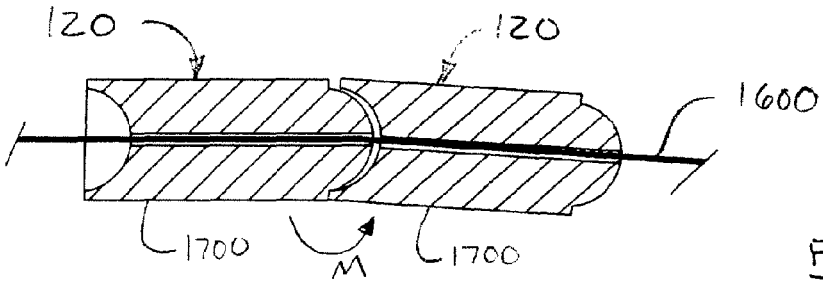

As shown in FIG. 17G, the compression members 120 generally include a body 1700, a convex mating end 1720 having shoulder portions 1740, a concave mating end 1730 having shoulder portions 1750, and a channel or passage 1710 running through the length of the body 1700 for the tension member 1600 and an optional pre-tensioning elastic member 1610 to pass through. In an alternative embodiment, the compression members 120 may not have shoulder portions 1740, 1750. The ball 1720 on the convex mating end may be smaller in circumference than the socket 1730 in the concave mating end so as to reduce the amount of friction created by the ends when the compression members 120 are brought together in, for example, an edge compression configuration, as will be described below. In other alternate embodiments the mating ends of the compression members 120 may have any suitable configuration such as, for example, a ball and socket or V-groove configuration as will be described below. The contact between the compression members 120 may have any suitable configuration such as, for example, an edge compression configuration, a frictional ball and socket configuration or a combination thereof.

The edge compression configuration, as can be seen in FIGS. 18A-18D, may generally have the tension member 1600 directed at, for example, the center of the compression member 120 through channel 1710 at a distance from the outer edge of the compression member. As the compression members are brought into tight end-to-end contact, the outer edges of the compression members, such as shoulders 1740, 1750 touch and create a turning moment M on the compression members 120. The turning moment M has the tension member 1600 running through the center of the compression member 120 in tension and the shoulders 1740, 1750 of the compression member 120 in compression. The tension member 1600 tries to force the compression members 120 into a straight column, but the compression members 120 are constrained by the shape of the canopy 300 as will be described below.

According to another exemplary embodiment and referring to FIGS. 31A-D, in the ball and socket configuration, the tension member 1600 is generally directed through the center of the compression members 3120 through channel 1710. The ball 3130 of one compression member 3120 fits into the socket 3140 of another compression member 3120. In the ball and socket configuration, there is no turning moment created by the shoulders 3150, 3160 due to the large contact surface and large amounts of friction created by the contact of the ball 3130 and socket 3140. As the tension member 1600 is tightened, the compression members become engaged in tight end-to-end contact. The friction created by the large contact surfaces of the ball 3130 and socket 3140 cause the frame to become rigid under high tension. As the hoop stress created by the tension member 1600 and the resisting forces created by the compression members 3120 try to reach equilibrium, they are constrained by the shape of the canopy 300.

Figure 32E:
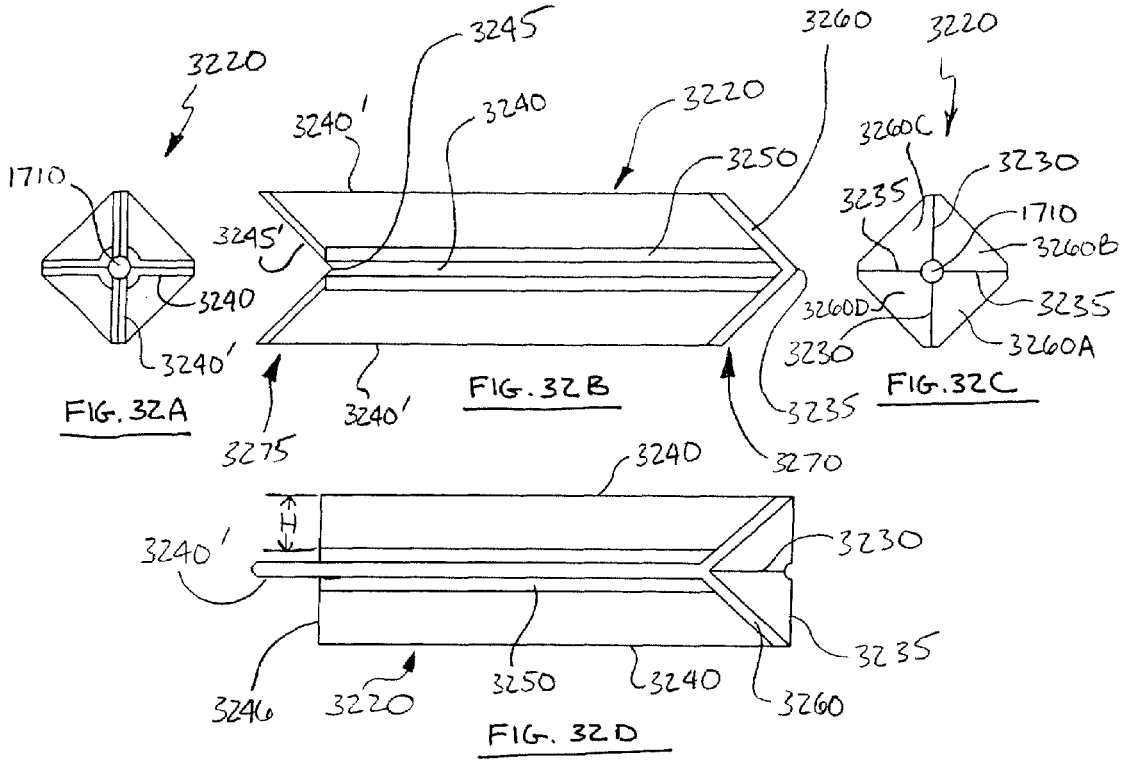
Figure 32E:
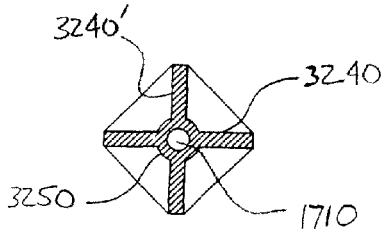

In another exemplary embodiment and as shown in FIGS. 32A-E, the compression members may have a V-groove interface configuration. FIGS. 32A and 32C respectively illustrate a left and right side view of the exemplary compression member 3220 while FIGS. 32B and 32D respectively illustrate a front and bottom view of the compression member 3220. FIG. 32E is a cross sectional view of the compression member 3220.

In this exemplary embodiment the compression member 3220 includes a hub 3250, a channel 1710, ribs 3240, 3240', a convex mating end 3270 having an interface surface 3260 and a concave mating end 3275. The channel 1710 runs through the length of the hub 3250 and provides a passage for a tension member such as tension member 1600. The ribs 3240, 3240' extend radially from the hub and are spaced ninety-degrees apart. In alternate embodiments, there may be any suitable number of ribs having any suitable spacing between them. In other alternate embodiments, the height H of the ribs 3240, 3240' may be any suitable height such as, for example, rib 3240 may have a greater height than rib 3240' so that an assembly of compression members has greater flexural strength in one direction than another. Referring to FIG. 12B, an example of applying greater flexural strength in one direction is when a support 320 of an umbrella includes an assembly compression members 3240. The ribs of compression members 3240 may provide greater flexural strength in the direction of arrow A to resist the cantilever forces created by the compression frames 1200, 1210.

Figure 32F:
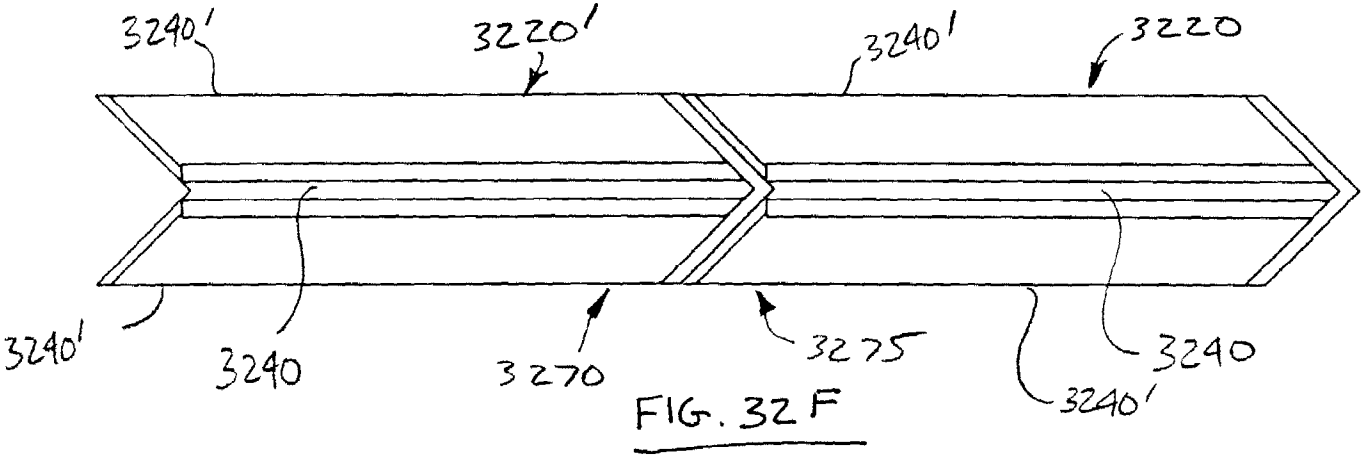
Figure 32G:
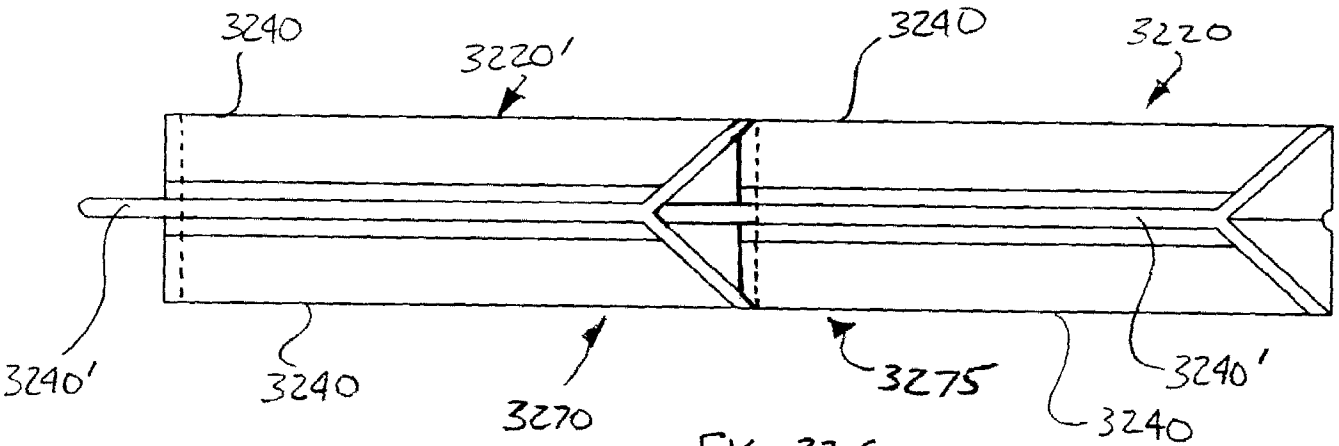

The V-shaped convex mating end 3270 is located opposite the V-shaped concave mating end 3275. The concave mating end 3275 may be formed by ribs 3240' and a V-shaped notch 3245 located on the edge 3246 of the ribs 3240. The ribs 3240' may flare at the convex mating end to form a V-shaped mating surface 3260. The ribs 3240 also extend into the surface 3260 to provide support and strength for the surface 3260. The surface 3260 may have four individual surfaces 3260A-D that form the surface 3260. The edges of the surfaces 3260A-D may meet to form peak 3235 and groove 3230. The peak 3235 may accept the V-shaped groove 3245 of another compression member 3220 while the groove 3230 may accept the V-shaped edges 3245' of ribs 3240' of another compression member 3220. Referring to FIGS. 32F and 32G (FIGS. 32F and 32F respectively illustrate a front and bottom view of an assembly of compression members 3220, 3220'), as the tension member 1600 is tightened, the compression members 3220, 3220' are brought into tight end-to-end contact. As the convex mating end 3270 of compression member 3220' engages the concave mating end 3275 of compression member 3220 the peak 3235 and groove 3230 in combination with the edges 3245, 3245' may align the compression members 3220, 3220' to form a rigid assembly. When aligned, the ribs 3240, 3240' of compression member 3220 are in line with the corresponding ribs 3240, 3240' of compression member 3220'. In alternate embodiments the convex and concave mating ends of the compression members 3220, 3220' may have any suitable configuration such as, for example, a pyramidical configuration.

The ribs 3240, 3240' may allow compression member 3220 to have a greater flexural strength to weight ratio to resist buckling. The open sides of the compression member 3220 may also allow for a smaller collapsed size when in an assembly of compression members 3220 due to the ability of the rib sections 3240, 3240' to interlock in the collapsed configuration.

The compression members of the exemplary embodiments disclosed herein may be used in any combination with each other. For example, support 320 of an umbrella may include the V-groove compression members 3220 while the compression frame includes either the ball and socket compression members 3120 or the edge compression compression members 120. As such, the compression members indicated as compression members 120 in the drawings may be substituted with, for example, any of the compression members disclosed herein.

The tension member 1600 may be any suitable device such as, for example, a cable, a cord, a monofilament line, a band, a strap or a chain. One or more tension members 1600 may run through the channels 1710 of the compression members 120 linking the compression members 120 end-to-end so that when the tension member 1600 is tightened the mating ends of the compression members 120 butt up against each other creating the rigid compression frame 130 as will be described in greater detail below. At least one end of the tension member 1600 may terminate within a retraction mechanism 110 which facilitates the tensioning or tightening of the tension member 1600.

The pre-tensioning elastic member 1610 may be optionally included in the channels 1710 to pre-tension the compression members 120 and assist in the opening of the support structure 100. The pre-tensioning member may be made of any suitable elastic material such as, for example, spring steel or rubber. The pre-tensioning elastic member 1610 may also take any suitable form such as, for example, a spring or band. The pre-tensioning elastic member 1610 runs through the channels 1710 and at least one end of the pre-tensioning elastic member terminates in the retraction mechanism 110.

The retraction mechanism 110 may be any suitable retraction device that is capable of retracting the tension member 1600 tightly so as to retain any tensile forces that are created. Examples of suitable retraction devices include lever actuators, cantor washers, cam actuators, drum winding winch reels, drum ratchets, drums with cam locks and linear ratchets. These retraction devices may be activated in any suitable manner such as, for example, manually, electronically, pneumatically or hydraulically. In one example, the retraction device may include a telescopic member 111 where extension of the telescopic member 111 causes tightening/retraction of the tension member 1600. In this example, the retraction mechanism 110 is shown as being located within the compression frame 130 SO that the compression members 120 depend from the retraction mechanism 110. The compression members may be attached to the retraction mechanism in any suitable manner such as, for example, a bracket or a socket joint. In alternate embodiments the retraction mechanism 110 may be located away from the compression frame, such as when the compression members depend from a support hub, such as hub 610 (FIG. 6) as will be described in greater detail below. The retraction mechanism 110 may have a large mechanical advantage to create a large tensile force with a minimum amount of input effort. In this example, the tensioning mechanism 110 may be configured to remove the slack from the tension member 1600 so that the compression members are brought together by rapidly retracting a first length of the tension member 1600, which may be under a small tensile load. The tensioning mechanism 110 may bring in a second length of the tension member 1600, which may be under a higher tensile load, with a much greater mechanical advantage to create the rigid compression frame 130.

The optional center support 210 operates in substantially the same manner as the compression frame 130 and in this example the center support 210 depends from the retraction mechanism 110 so as to create a cantilever member extending from the retraction mechanism 110. In alternate embodiments the center support 210 may depend from hub 610. In other alternate embodiments, the center support may have any suitable configuration such as that shown in FIG. 11. In this example, one center support 210 is shown, however in alternate embodiments any suitable number of center supports may be employed.

Figure 11:
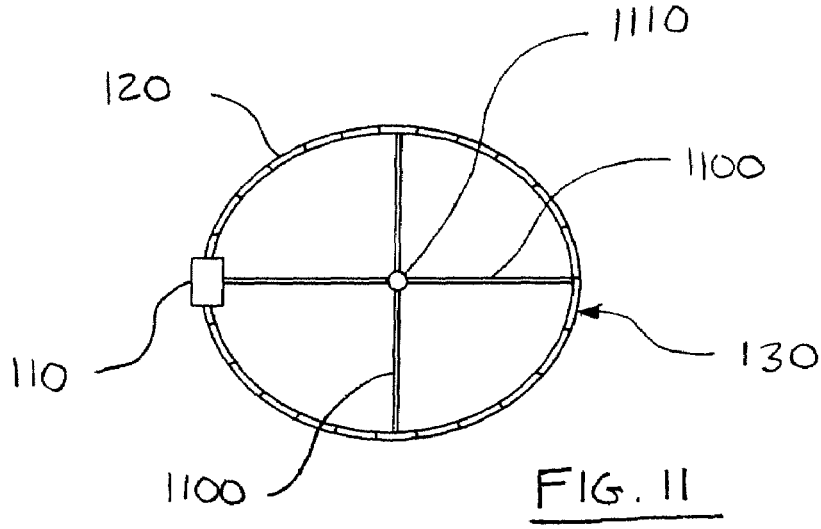

As can be seen in FIG. 11, the center support may include support sections 1100 that may span across the entire compression frame 130 and form, for example, a cross within the compression frame 130. The support sections 1100 may be connected to the compression frame in any suitable manner. The support section 1100 may be connected to each other at the center of the compression frame 130 by a center hub 1110. The center hub 1110 may be made of any suitable material and have any suitable configuration. The center support includes compression members 120, at least one tension member 1600 and optionally at least one pre-tension elastic member 1610. The center support 210 may add support to the compression frame to hold the canopy 200 in a horizontal position. The center support 210 may increase the rigidity of the compression frame 130 by carrying a portion of the compression frame's weight to prevent any flexing of the cantilevered frame 130. The center support 120 may also prevent sagging of the canopy 200 from, for example, wind forces or the weight of rainwater or snow.

Figure 16:
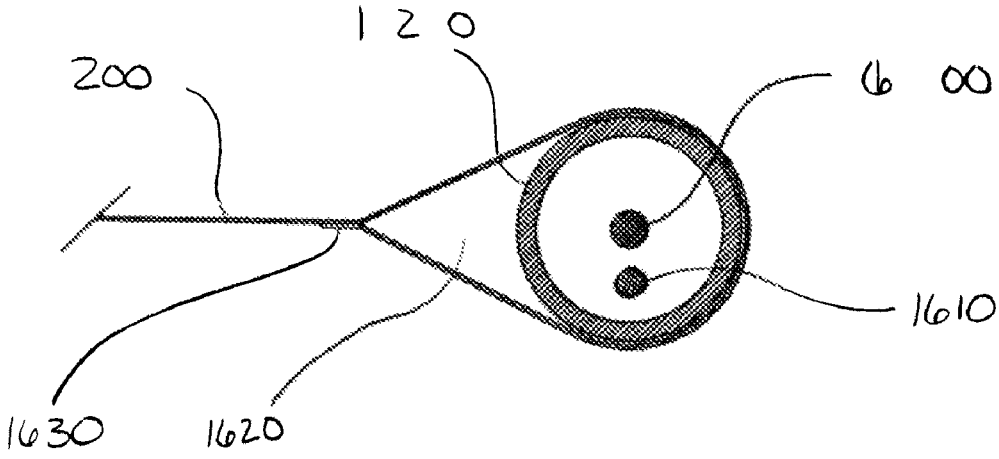
FIG. 16 illustrates a cross-sectional view of a compression member with a canopy attached in accordance with an exemplary embodiment.

The canopy 140, 200 may generally be any suitable flat piece of flexible fabric or material such as, for example, nylon, rubber, plastic or canvas. The canopy may be treated to improve the water resistant qualities of the material. The canopy 140, 200 may act as a barrier, shield or cover to separate or protect one area from another and extends around the perimeter of the compression frame 130. The canopy may have a channel 1620 running around its perimeter, as can be seen in FIG. 16. The channel 1620 may be formed by folding over the material at the edge of the canopy 140, 200 and causing a joining of the canopy material at a point 1630 around the perimeter of the canopy 140, 200. The material may be joined in any suitable manner such as sewing, chemical or mechanical adhesive, mechanical fasteners or welding. The channel 1620 allows the compression frame 130 to pass through the canopy 140, 200 so that the canopy forms a structural component that acts as a tension member that may constrain the compression members 120 from expanding outward (e.g. the compression members 120 and the compression frame 130 take the shape of the canopy 140, 200). The amount of constraint exerted by the canopy 140, 200 on the compression frame 130 may depend on the elasticity of the flexible material in that the less elastic the material is the greater the constraint.

At least one canopy position assist member 1330 (FIG. 13B) my also be included. The assist member 1130 may help position the canopy 140, 200 around the perimeter of the compression frame 130 as the canopy 140, 200 is opened by pulling the annular channel 1620 over the compression frame 130 as the frame is opened. The at least one assist member 1330 may be any suitable elastic member such as a spring, shock cord or elastic band. The at least one assist member 1330 is attached at one end to the hub 1110 and attached at the other end to the openings of the canopy's annular channel 1620. In alternate embodiments, the canopy may be attached to the retraction mechanism 110 (or hub) in any suitable manner, such as for example, chemical adhesive, mechanical fasteners and the like in such a way to prep position the canopy for opening and to prevent any possible gaps from forming between the retraction mechanism 110 (or hub).

The support structure 100, 220 with the inner flexible material 140, 200 has two positions, i.e. unopened and opened. In the unopened position, the tension member 1600 is loose and the compression members 120 are free to move so that the support structure and flexible material 140, 200 may be folded and stored. To open the support structure 100 the retraction mechanism 110 is caused to bring the tension member 1600 taut, which may bring the compression members 120 in close proximity to each other creating a substantially rigid ring, for example. The flexible material 140, 200 may constrain the compression members 120 to a predetermined shape and is stretched tight by the compression members 120, which are under load from the tension member 1600.

Figure 3A:
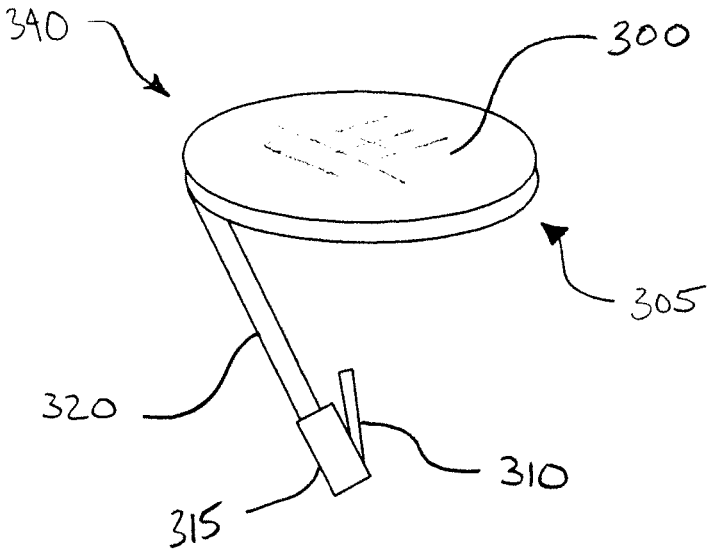
FIGS. 3A-B show a personal protective apparatus in accordance with an exemplary embodiment.
Figure 3B:
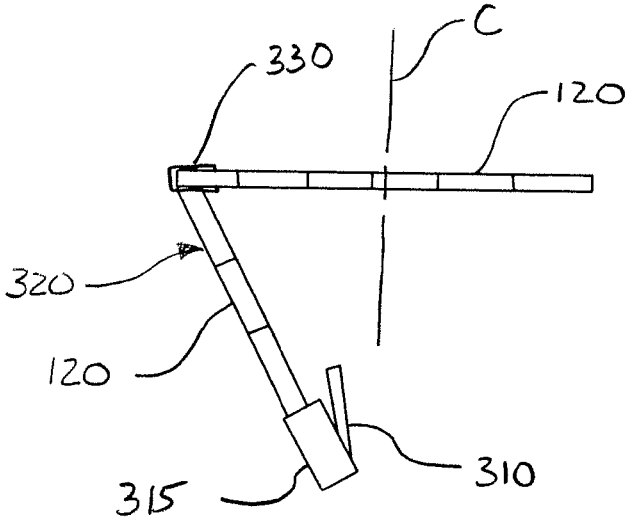
Figure 4:
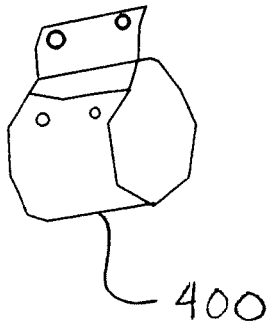
FIG. 4 illustrates a storage device for the personal protective apparatus of FIGS. 3A-B in accordance with an exemplary embodiment.
Figure 5A:
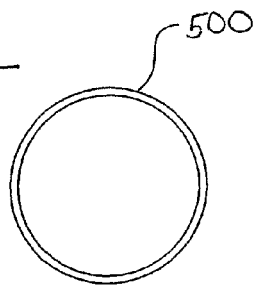
FIGS. 5A-F illustrate exemplary support structures in accordance with an exemplary embodiment.
Figure 5B:
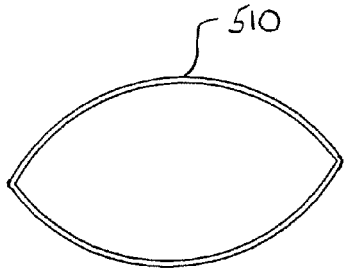
Figure 5C:
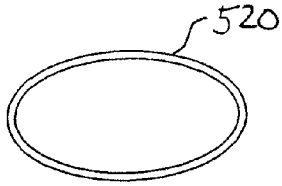
Figure 5D:
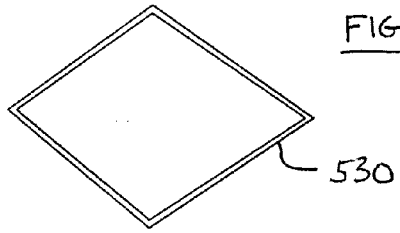
Figure 5E:
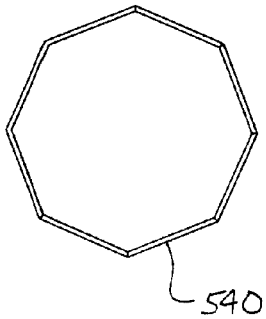
Figure 5F:
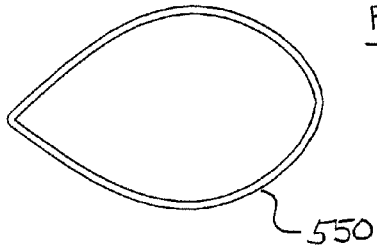

The support structure 100 described herein may be used in many different applications. For example, in one exemplary embodiment the support structure 100 may be used in an umbrella application as can be seen in FIGS. 3A-4. The support structure 305 and the canopy 300 are substantially similar to the support structure 100 and canopy 140 described above.

Figure 20:
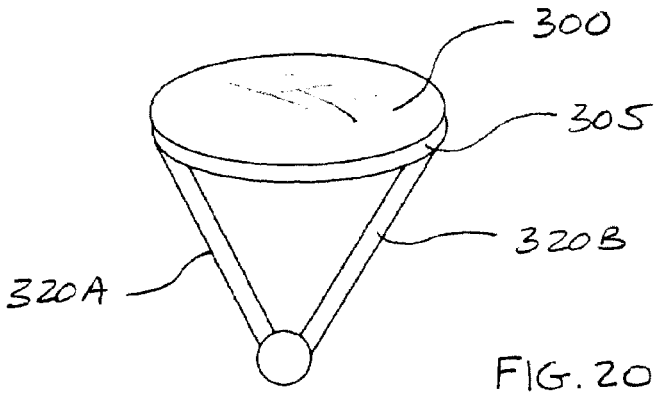
FIG. 20 illustrates a frame configuration with two edge supports in accordance with an exemplary embodiment.

In this example, any suitable support member such as, for example, pole support 320 may be used to hold the support structure 305 and canopy 300 away from the item to be protected. In alternate embodiments any suitable number of pole supports may be used, such as two pole supports 320A, 320B, for example, as can be seen in FIG. 20. The pole support 320 may be positioned at an angle to the support structure 305. In alternate embodiments the pole support 320 may have any suitable angular relationship to the support structure 305 such as perpendicular. The pole support 320 may extend towards the center C of the support structure 305 or it may extend away from the center C. By having the pole support 320 positioned at an angle towards the center of the support structure 305, the center of mass of the support structure 305 and canopy 300 may be positioned directly over the handle or mounting area of the pole support 320 causing the assembly to have very little or no turning moment when held by, for example, a user or otherwise. In alternate embodiments the pole support 320 may extend in any suitable direction. The pole support 320 may also have any suitable length.

The pole support 320 is constructed in substantially the same manner as the compression frame 130 in that the pole support 320 includes compression members 120, tension members 1600 and optionally pre-tension elastic members 1610. In alternate embodiments, the pole support 320 may be a solid rod (i.e. the rod does not fold or collapse) made of any suitable material such as, for example, a hollow metal, plastic or fiberglass tube, or it may have a solid cross-section. In other alternate embodiments, the pole support 320 may be, for example, a telescopic or folding support. The pole support 320 may also have any suitably shaped cross section such as those shown in FIGS. 17A-17F.

The pole support 320 may be connected to the support structure 305 through hub 330. In alternate embodiments, the pole support 320 may be connected to any suitable member of the support structure/canopy assembly such as, for example, the canopy 300 or if equipped the center support assist member 210 (FIG. 2). The hub 330 may be made of any suitable material and have any suitable cross-section. The hub 330 may be a rigid member with great strength to which the support structure 305 components are attached. The support structure components may be attached to the hub 330 in any suitable manner such as, for example, a bracket or a socket joint. The hub 330 may transfer the weight and cantilever load of the canopy 300 and support structure 305 to the pole support 320. The hub 330 may be located on the perimeter of the support structure 305 and may serve to redirect the tension member 1600, pre-tension elastic member 1610 from the retraction mechanism 315 to the compression members 120 of the support structure 305.

Figure 8A:
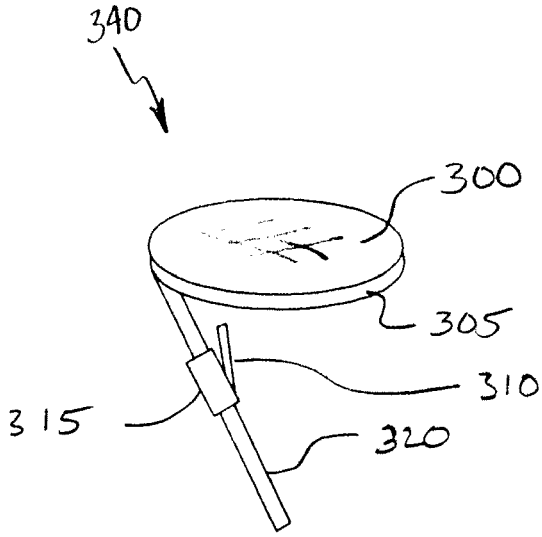
Figure 8B:
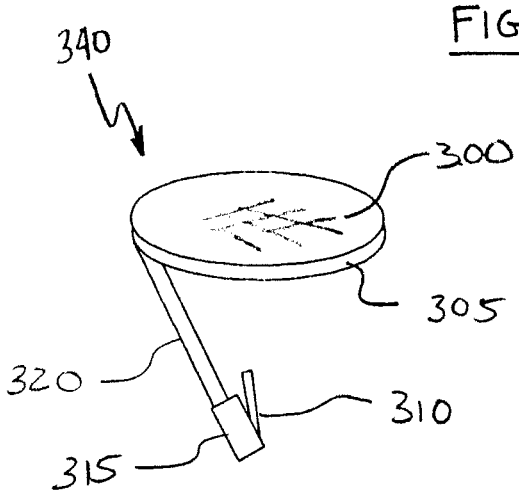
Figure 8C:
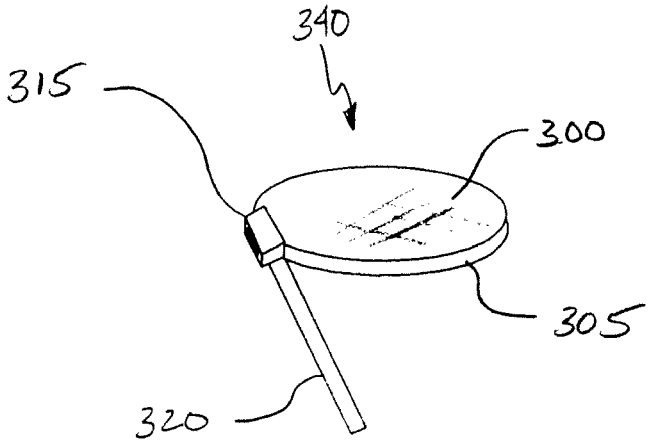
Figure 9:
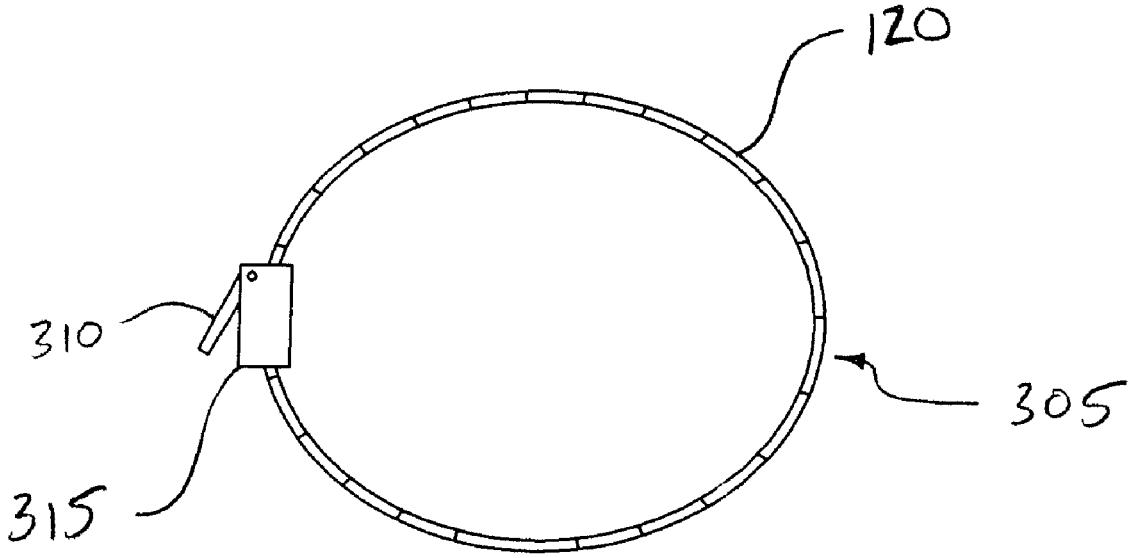

In this example the retraction mechanism 315 is shown as being located on the pole support 320 rather than on the perimeter of the support structure 305. The retraction mechanism may also serve as the handle for a user to hold the umbrella 340. The retraction mechanism may have an actuator 310 which when actuated causes the tightening of the tension member 1600. In alternate embodiments, the retraction mechanism may be located in any suitable location on the umbrella 340. For example, FIGS. 8A-8C show the umbrella 340 having the retraction mechanism 315 located in various places. FIG. 8A shows the retraction mechanism 315 located approximately at a midpoint of the pole support 315, FIG. 8B shows the retraction mechanism 315 at the end of the pole support 320 and FIG. 8C shows the retraction mechanism 315 located at the point the pole support 320 connects to the support structure 305 (e.g. the hub). FIG. 9 shows a detailed view of the retraction mechanism 315 with the compression members 120 of the support structure 305 depending therefrom.

In operation a user may remove the umbrella 340 from its storage case or bag, such as case 400 (FIG. 4). If equipped, the pre-tension elastic member 1610 may assist the user in unfolding the umbrella 340. The user actuates the actuator 310 of the retraction mechanism 315 puts the tension member 1600 into tension (i.e. causing the tension member 1600 to tighten). The tightening of the tension member 1600 causes the compression members 120 of the pole support 320 and the support structure 305 to come together into tight end-to-end contact (e.g. open) and be in a state of compression. As the support structure 305 opens the tension member 1600 exerts a hoop stress on the compression members 120. The compression members exert an equal resisting radial force on the tension member 1600. As these forces equalize the optimal shape for the support structure 305 is, in this example, a circle, which is constrained by the flexible material of the canopy 300.

As the rigid support structure 305 opens up it causes the canopy 300 to unfold and stretch to an open position which in this example forms a flat surface for protecting the user from the elements, such as rain or snow. The canopy exerts a resistant force on the support structure 305, which constrains the support structure 305 to the shape of the canopy 300. In the case where the retraction mechanism 315 is located in a position such as the positions shown in FIGS. 8A and 8C, there may be two tension members 1600 connected to the retraction mechanism 315. A first tension member 1600 may run from the retraction mechanism 315 to the support structure 305 (and the upper portion of the pole support 320 as in FIG. 8A) while a second tension member 1600 runs from the retraction mechanism 315 to the pole support 320.

A variety of forces acting on the compression members may form the rigid frame (e.g. support structure 305 and pole support 320). Those forces include the turning moment M created by the shoulders 1740, 1750 of the compression members 120 (or alternatively the frictional forces created by the ball and socket of the compression members), the hoop stress created by the tension member which resists the rotational forces that may be caused by the weight of the cantilever arm and by the tension or radial resistant forces created by the canopy which resists the resultant forces of the tension and compression members trying to achieve an equilibrium state of hoop stress pushing against the radial resistant forces.

An umbrella in accordance with the disclosed embodiments may provide a greater usable or protective area under the canopy than conventional umbrellas in that the pole support is attached to the frame at a point on the frame's perimeter rather than in the center of the umbrella. Also, an umbrella according to the exemplary embodiments may not be turned inside out due to wind forces, as there is no concave rib structure to bend or blow out.

Figure 14:
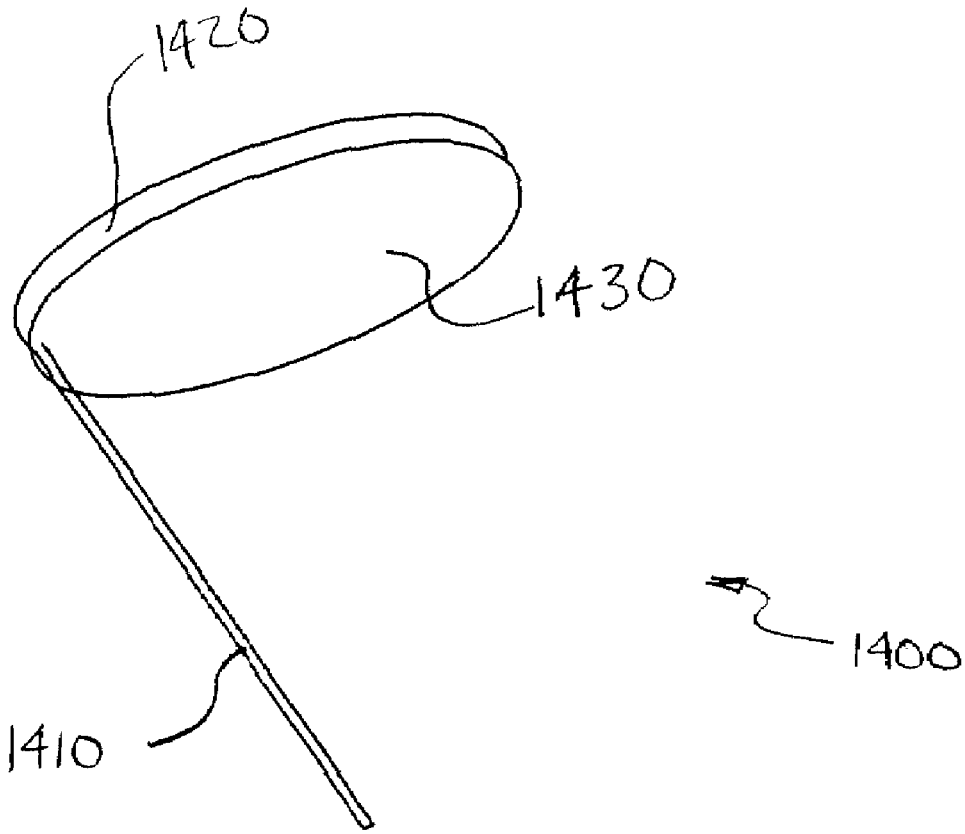

Referring now to FIG. 14, a protective device is shown. The protective barrier 1400 is substantially similar to that of FIGS. 3A-3B. However, the pole support 1410, compression frame 1420, retraction mechanism (not shown), hub (not shown) and canopy 1430 may be adapted for use in harsh environments such as, for example, in outer space. The components of the protective barrier 1400 may be of any suitable material to withstand extreme temperatures and radiation. The canopy 1430 may be of any suitable material so as to reflect or block solar radiation that may be hazardous to, for example, an astronaut.

Figure 6A:
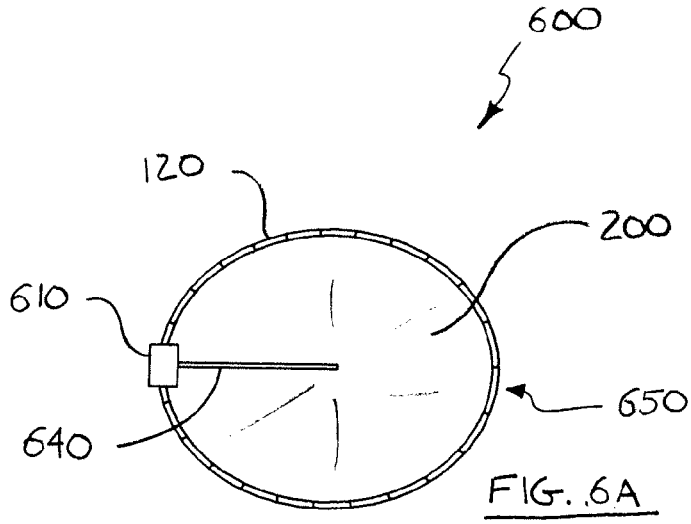
FIGS. 6A-C, 7, 8A-C, 9, 10A-B and 11 illustrate protective devices in accordance with an exemplary embodiment.
Figure 6B:
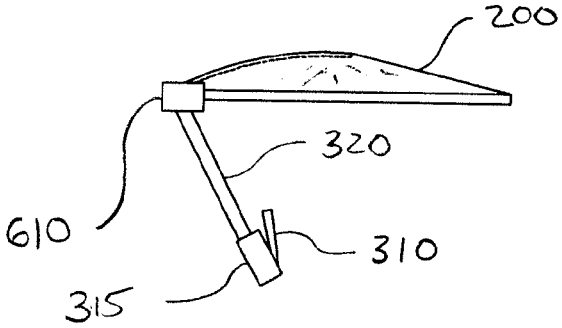
Figure 6C:
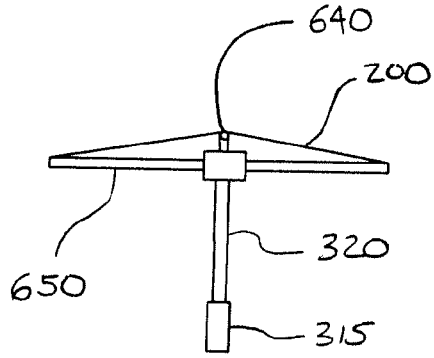

In another exemplary embodiment, as can be seen in FIGS. 6A-6C, an umbrella 600 is shown. The umbrella 600 is substantially similar to umbrella 340 described above unless otherwise noted. As such, like components will have like reference numbers. The support structure 650 of umbrella 600 utilizes a center support assist member 640 as described above with respect to FIGS. 2A-2B. The center support assist member 640 is substantially similar to the center support assist member 210 in that it includes compression members 120, tension member 1600 and optionally pre-tension elastic member 1610. The center support assist member 640 is connected to and depends from the hub 610. Hub 610 is substantially similar to hub 330 described above.

Umbrella 600 operates in substantially the same manner as that described above for umbrella 340 (FIGS. 3A-4) but the retraction mechanism also causes the compression members 120 of the center support assist member 640 to come together to for a rigid support. The center support assist member 640 may be located underneath the canopy 200 so as to support the canopy from the bottom or it may be located within a channel similar to channel 1620 (FIG. 16). The center support assist member provides a contoured shape to the canopy 200 that may prevent the canopy 200 from sagging under the weight of, for example rain water.

Figure 7:
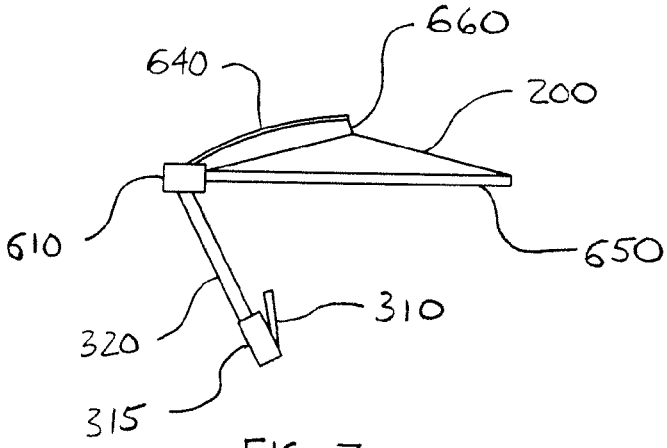

In alternate embodiments the center support assist member 640 may be located above the canopy 200 as can be seen in FIG. 7. In this example, the center support assist member 640 may be connected to the canopy 200 by a connection member 660. The connection member 660 may be any suitable member such as, for example, a cord, string, wire, or a piece of the canopy's flexible material. The center support assist member 640 and the connection member 660 support the canopy 200 from above to, for example, prevent the canopy 200 from sagging.

Figure 10A:
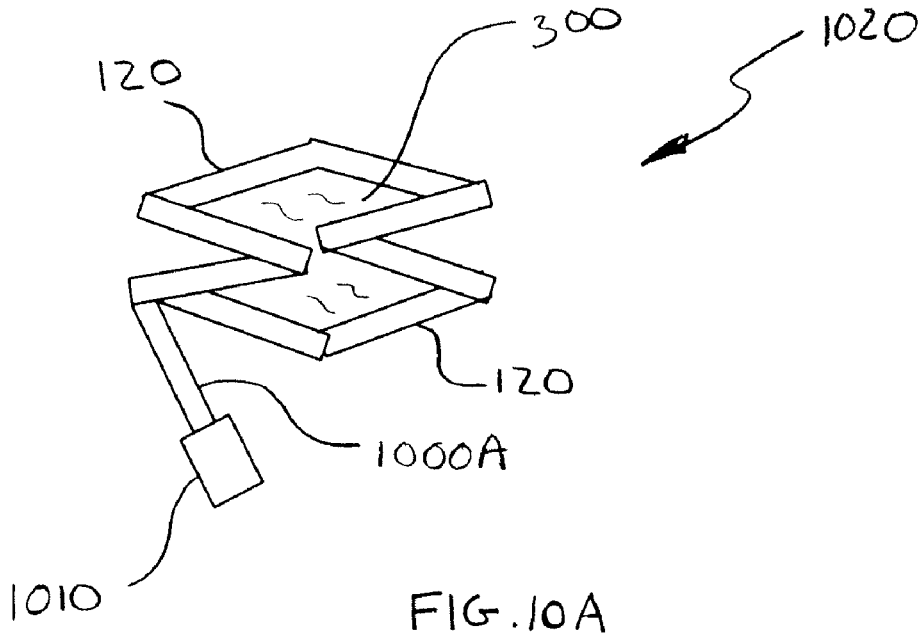
Figure 10B:
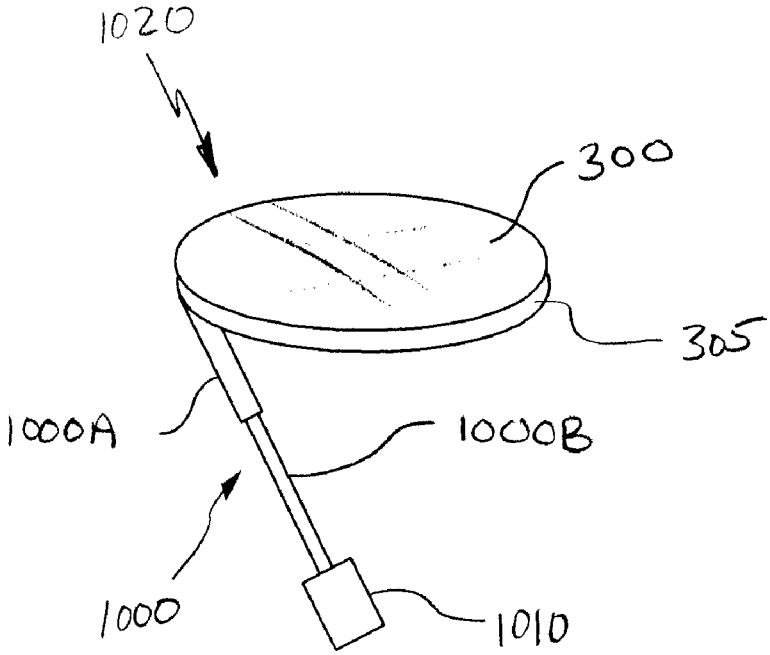

Referring now to FIGS. 6A-6C an umbrella 1020 is shown. The umbrella 1020 is substantially similar to umbrella 340 described above unless otherwise noted. As such, like components will have like reference numbers. In this example, the canopy 300 and support structure 305 are substantially similar to that described above with respect to FIGS. 3A and 3B however, the pole support 1000 is a telescopic support incorporating a retraction mechanism. The support 1000 may have any suitable length and cross-section and be made of any suitable material. The combination pole support/retraction mechanism 1000 includes an upper portion 1000A and a lower portion 1000B. In this example the lower portion 1000B has a handle 1010 and is extended from and retracted into upper portion 1000A. In alternate embodiments, the support 1000 may have any suitable configuration. The tension member 1600 may be connected to the lower portion 1000B of the support 1000 so that the extension of the lower portion 1000B from the upper portion 1000A causes the tension member 1600 to tighten causing the compression members 120 to come together in tight end-to-end contact. As the lower portion 1000B is extended and the tension member 1600 is tightened, the umbrella 1020 is caused to change from a folded configuration as can be seen in FIG. 10A to a rigid unfolded configuration as shown in FIG. 10B. The support 1000 may be provided with a locking mechanism that serves to keep the lower portion 1000B of the support 1000 extended. The locking mechanism may be a linear ratcheting mechanism, a snap, a detent or any other suitable locking device. A release mechanism may also be provided to release the locking mechanism so that the lower portion 1000B may be retracted into the upper portion 1000A of the support 1000 causing the compression member to become separated into the folded configuration.

Figure 12A:
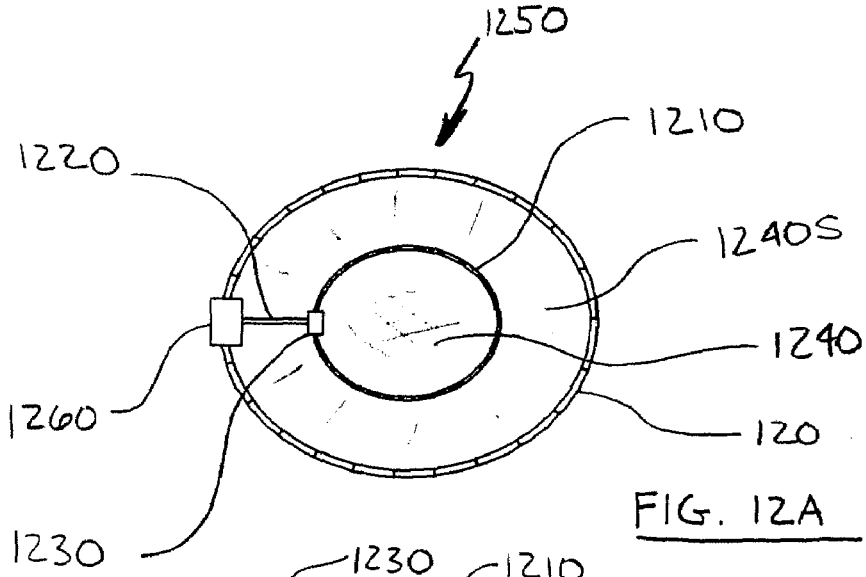
FIGS. 12A-B, 13A-C, 14 and 15A-C illustrate protective devices in accordance with an exemplary embodiment.
Figure 12B:
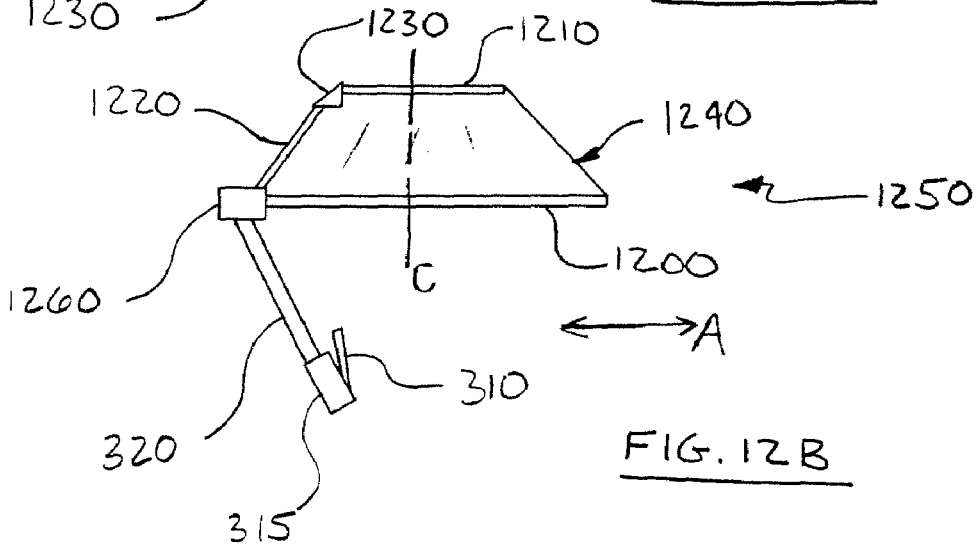

As can be seen in FIGS. 12A and 12B, an umbrella 1250 according to one exemplary embodiment may have multiple compression frames 1200, 1210. In this example, the umbrella 1250 generally includes a retraction mechanism 315 with an actuator 310, a lower hub 1260, a lower compression frame 1200, an upper compression frame support 1220, an upper hub 1230, and upper compression frame 1210 and a canopy 1240. The retraction mechanism 315, actuator 310 and pole support 320 are substantially similar to the retraction mechanism, actuator and a pole support described above with respect to FIGS. 3A-3B. The upper and lower compression frames 1210, 1200 and hubs 1260, 1230 are also substantially similar to compression frame 130 and hub 330 described above.

In this example, the pole support 320 is shown as being attached to the lower hub 1260 at an angle so that the handle or retraction mechanism 315 is in proximity to the center C of the umbrella 1250. In alternate embodiments the pole support 320 may be attached at any angle such as, for example, perpendicular to the lower compression frame 1200 or angled away from the center of the umbrella 1250.

The lower compression frame 1200 and the upper compression frame support 1220 depend from the lower hub 1260 and may be any suitable size. In this example there are two compression frames, but in alternate embodiments any suitable number of compression frames may be used. The upper compression frame support may include at least one compression member 120 or it may be a rigid support, such as a hollow shaft. One end of the upper compression frame support 1220 is shown as being attached to and depending from the lower hub 1260 at an angle so that it extends towards the center C of the umbrella. The upper hub 1230 is attached to the other end of upper compression frame support 1220. The upper compression frame 1210 depends from the upper hub 1230. As can be seen in FIG. 12A, the upper compression frame support 1220 is positioned such that the upper compression frame 1210 is substantially centered with the lower compression frame 1200. In alternate embodiments the umbrella 1250 may be configured so that the upper compression frame 1210 is in any suitable location with respect to the lower compression frame 1200.

The canopy 1240 may be any suitable flexible material and may have an upper channel and a lower channel for the upper and lower compression frames 1210, 1200 to pass through. The upper and lower channels may be substantially similar to the channel 1620 shown in FIG. 16. The upper compression frame support 1220 and upper hub 1230 may be located on the underside of the canopy 1240 to prevent any possible gaps that may be formed in the canopy for the hub and upper compression frame to pass through. In alternate embodiments the upper channel in the canopy may be located on the outside of the canopy so that the support 1220, the hub and upper compression may be located on the outside of the canopy without passing through to the inside of the canopy. In alternate embodiments the umbrella 1250 may have any suitable configuration.

In this example, at least two tension members 1600 may run through the umbrella 1250. One tension member may run from the retraction mechanism 315 through the pole support 320, the lower hub 1260 and around the lower compression frame 1200. The second tension member may run from the retraction mechanism, through the pole support 320, the lower hub 1260, the upper compression frame support 1120 and around the upper compression frame 1210. As described above, a pretension-elastic member 1610 and/or canopy position assist member 1330 may also be incorporated into the umbrella 1250.

In operation, the umbrella 1250 opens in a substantially similar manner to umbrellas 340 and 600. For example, when a user actuates the actuator 310 of the retraction mechanism 315 the tension members 1600 are caused to tighten and bring the compression members 120 of the pole support 320, the upper and lower compression frames 1210, 1200 and the upper compression frame support 1220 in tight end-to-end contact to form a rigid frame for the umbrella 1250. As the umbrella 1250 is opened and the compression frames take, for example, the oval shape shown in FIG. 12A the canopy 1240 is stretched by at least the upper compression frame 1210 to form, for example, a upper flat protective barrier 1240T. The lower compression frame 1200 may also stretch the side of the canopy 1240S so that the side of the canopy 1240S is taut between the upper and lower compression frames 1210, 1240. In alternate embodiments the sides of the canopy may not be taut between the upper and lower compression frames 1210, 1200.

In this example, the upper and lower compression frames 1210, 1200 along with the canopy 1240 form a conical shape having sides that may provide additional protection to a user. In alternate embodiments, any suitable shape may be formed by the compression frame/canopy assembly such as, for example, a box, a dome or a pyramid shape.

Figure 13A:
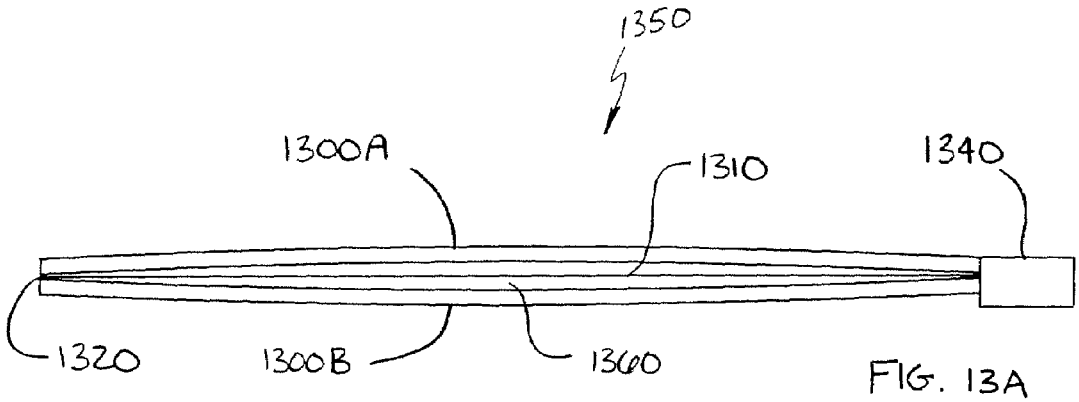
Figure 13B:
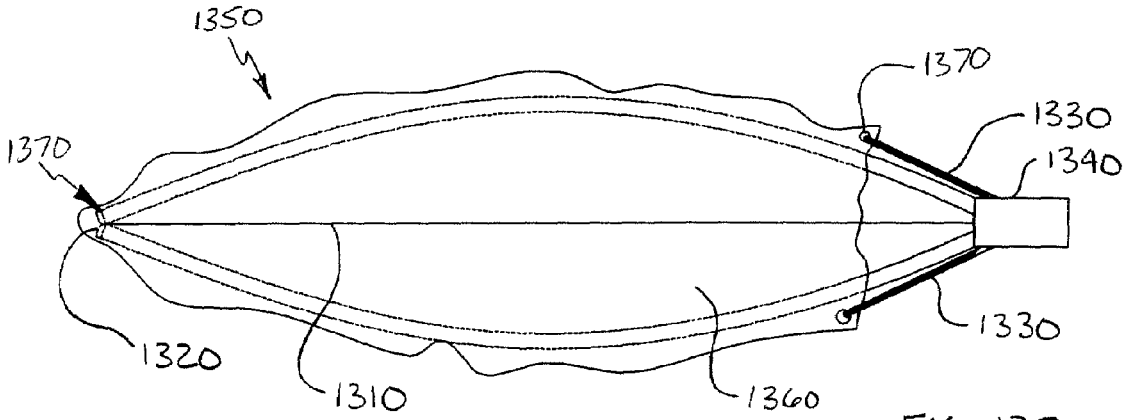
Figure 13C:
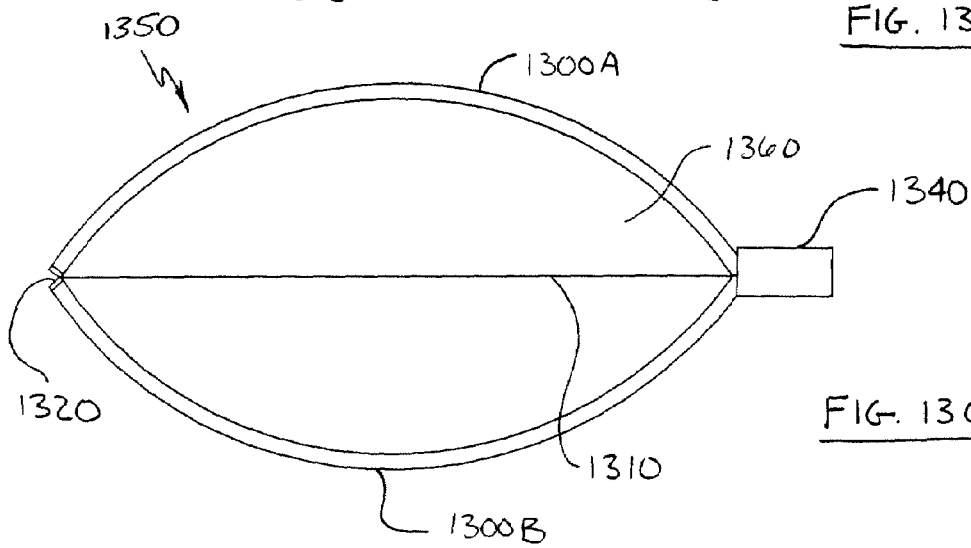

Referring now to FIGS. 13A-13C, another exemplary embodiment is shown. In this embodiment the protective barrier 1350 generally includes a retraction mechanism/hub 1340, compression members 1300A, 1300B, at least one tension member 1310, a canopy 1360 and canopy position assist members 1330. The retraction mechanism/hub 1340, tension members 1310, canopy 1360 and canopy position assist members 1330 are substantially similar to those described above with respect to FIGS. 1A-3B. The compression members 1300A, 1300B may have substantially similar compression properties as compression members 120. In this example the compression members 1300A, 1300B are shown as one piece members but in alternate embodiments the compression members 1300A, 1300B may be, for example, telescopic rods, folding members or otherwise collapse to a shorter length.

In this example, the compression members 1300A, 1300B are attached at one end to the retraction mechanism/hub 1340. The compression members 1300A, 1300B are attached or joined to each other at a second end by, for example, a hinge 1320. The hinge may be any suitable hinge such as, for example, a mechanical hinge having a pivot or a living hinge made from any suitable material such as polypropylene plastic. In alternate embodiments, the compression members 1300A, 1300B may be connected to each other in any suitable manner. The tension member 1310 is connected at one end to the retraction mechanism 1340 and is connected at its other end to the joined ends of the compression members 1300A, 1300B at, for example, the hinge 1320. The tension member 1310 may be connected to the hinged end 1370 of the compression members 1300A, 1300B in any suitable manner. The canopy 1360 is attached to the compression members in that the compression members 1300A, 1300B are passed through a channel substantially similar to channel 1620 described above that may run around the perimeter of the canopy 1360. The canopy position assist members 1330 are connected at one end to the retraction mechanism/hub 1340 and at the other end to an eyelet 1370 of the canopy 1360.

In operation, the canopy position assist members 1330 may hold the canopy 1360 towards the retraction mechanism 1340 to assist in the opening of the protective barrier 1350. A user actuates the retraction mechanism 1340, which causes the tension member 1310 to tighten. The tightening of the tension member 1310 causes the hinged end 1370 of the compression members 1300A, 1300B to be pulled inwards towards the retraction mechanism. The hinge 1320 may allow the hinged end 1370 of the compression members 1300A, 1300B to rotate about a pivot point of the hinge 1320 while constraining the movement of the compression members 1300A, 1300B to a single plane. The inward motion of the hinged end 1370 causes the compression members 1300A, 1300B to bow or flex laterally outward relative to a longitudinal axis defined by the tension member 1310. As the compression members 1300A, 1300B are flexed outward to form, for example, a football shape, the canopy is stretched and held taut by the compression members. In this example the tension member 1310 may run along the bottom of the canopy and support the canopy 1360 from sagging. The tension member may also run through a channel in the canopy 1360.

In this example, the retraction mechanism may be attached to a pole support that may be held by a user, supported on a suitable stand or driven into the ground. The canopy, when opened, may be positioned in any suitable orientation such as, for example, parallel to the ground or perpendicular to the ground.

Figure 15A:
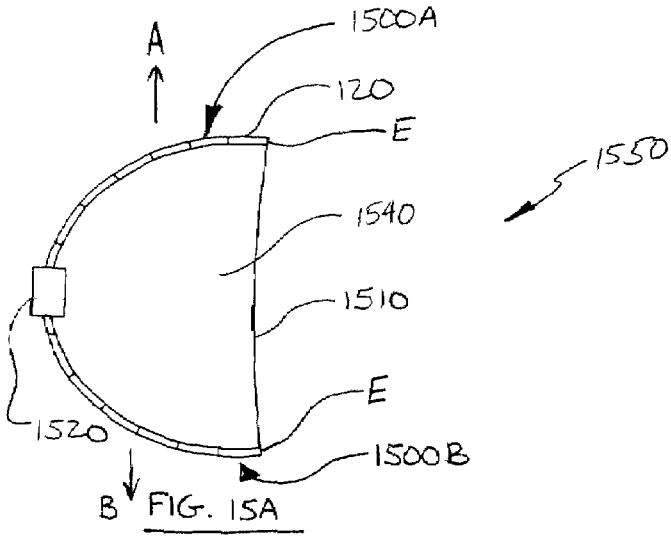
Figure 15B:
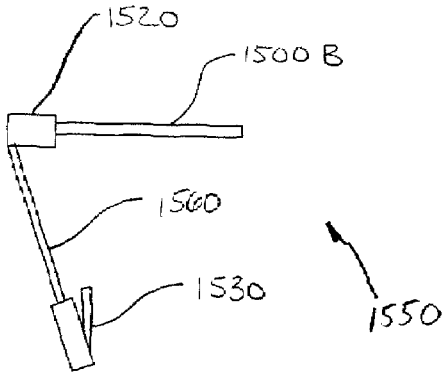
Figure 15C:
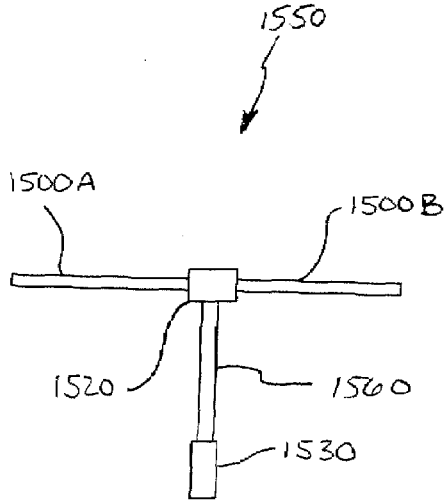

In accordance with another exemplary embodiment, an umbrella 1550 having an open ended canopy 1540 is shown in FIGS. 15A-15C. The umbrella 1550 generally includes a retraction mechanism 1530 having an actuator, a pole support 1560, a hub 1520 and two arms 1500A, 1500B. The retraction mechanism 1503, pole support 1560 and hub 1520 may be substantially similar to those described above with respect to FIGS. 3A-3B. The arms 1500A, 1500B include compression members 120 as described above with respect to the compression frame 130 however, the tension member 1600 that runs through the arms is connected at one end to the retraction mechanism 1530 while the other end of the tension member 1600 terminates at the ends E of the arms 1500A, 1500B. The open end umbrella 1550 may also include a center support assist member 210, pre-tension elastic members 1610 and canopy position assist members 1330 as described above.

In operation a user actuates the retraction mechanism 1503 which causes the tension member to tighten bringing the compression members of the pole support 1560 and the arms 1500A, 1500B in tight end-to-end contact as described above with respect to FIGS. 1A-2B. Because tension members 1600 terminate at the end E of each arm 1500A, 1500B and because the compression members 120 of the arms 1500A, 1500B do not form a ring, there is a tendency for the arms 1500A, 1500B to form a straight rigid column and extend away from each other in directions A, B as the tension members are tightened. This extension of the arms 1500A, 1500B cause the canopy 1540 to open so that the edge 1510 of the canopy is held taut. As described above, the canopy 1540 exerts a resistive force on the arms 1500A, 1500B and constrains the arms to the shape of the canopy, which in this example is a general "U" shape. In alternate embodiments, the canopy 1540 may constrain the arms 1500A, 1500B to any suitable shape.

Figure 19:
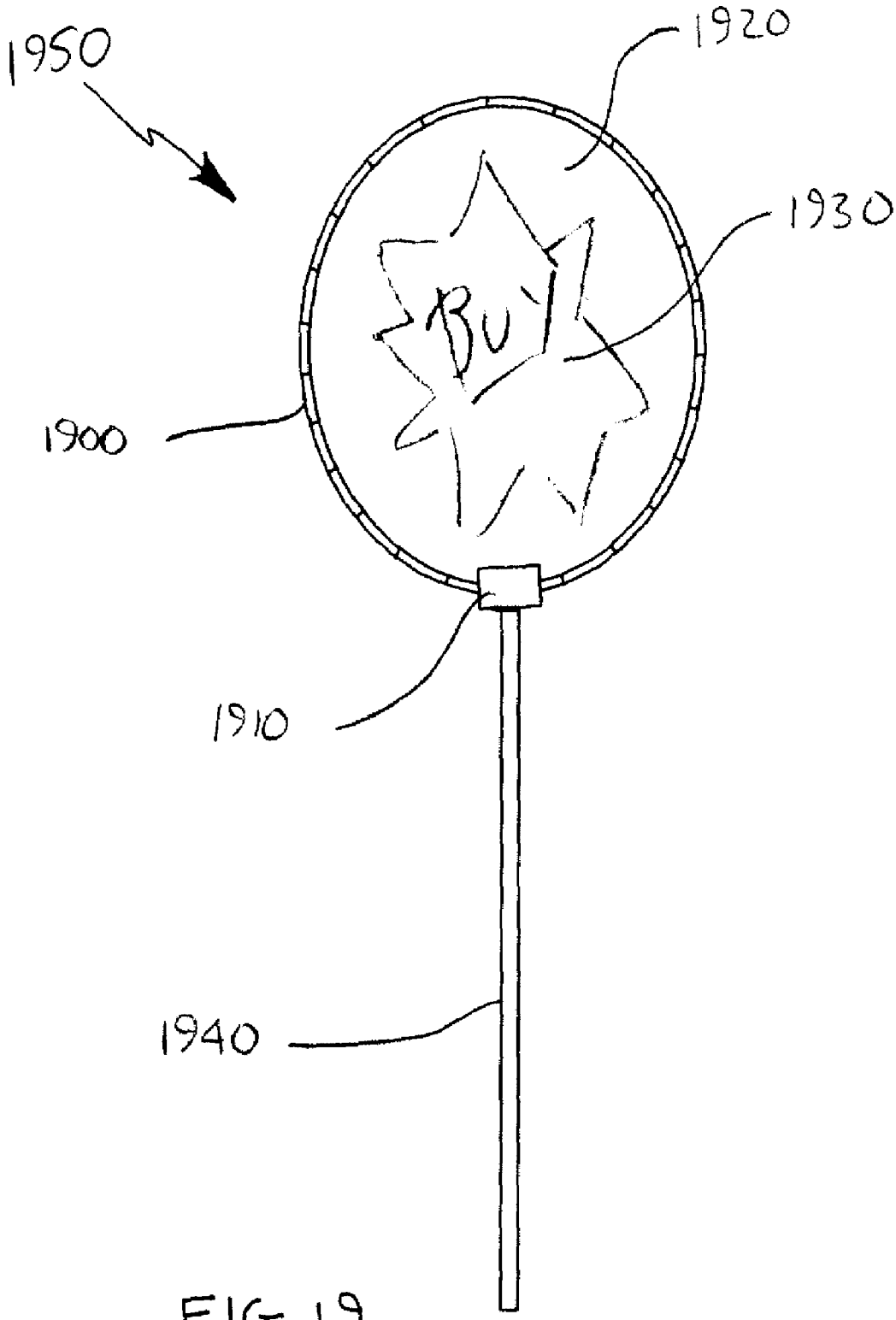
FIG. 19 illustrates a sign in accordance with an exemplary embodiment.

The embodiments described above may not only be employed for the protection of a user but may also be employed as a display 1950 for displaying any suitable printed material 1930 such as messages, pictures and the like for advertising or any other desired purpose. As can be seen in FIG. 19, any of the embodiments described above such as, for example, FIGS. 1A-2*b* and 13A-13C may have a pole support 1940 that extends from the retraction mechanism or hub 1910 in such a manner as to position the compression frame 1900 and canopy 1920 for optimal viewing by passers by or any interested person. The pole support 1940 may be supported by a suitable stand, held by a user or driven into the ground. The display 1950 may, for example, be placed in a storefront, along the side of a road or any other suitable location. The display 1950 in accordance with this exemplary embodiment is easily stored in a compact manner and may be quickly deployed or taken down.

Figure 21:
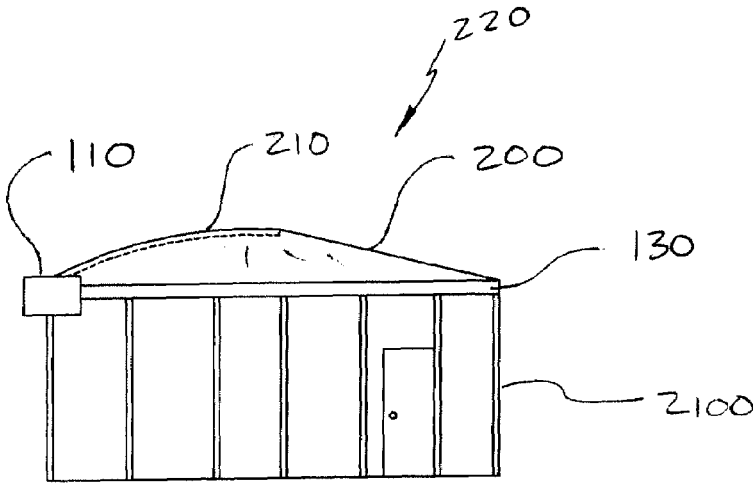
FIGS. 21-22 illustrate shelters having roofs in accordance with an exemplary embodiment.
Figure 22:
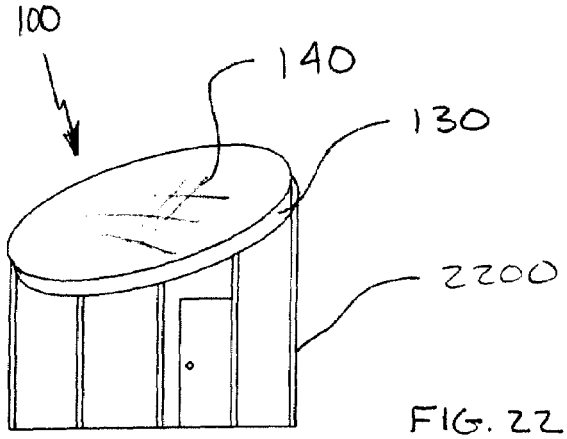

In accordance with another exemplary embodiment, the support structures of the disclosed embodiments may be used, for example, in building structures, tents or other structures that may be quickly deployed. As can be seen in FIGS. 21 and 22, the support structures 220 and 100 of FIGS. 1A-2B may be produced in a suitable size so as to form a roof on a building structure 2100, 2200. Because of the larger size, the support structures 200, 100 may be divided into any suitable number of sections where each section has its own retraction mechanism 110. The building structure 2100, 2200 may be a portable structure that may act as a temporary shelter. The support structures 220 and 100 may enable the shelter to be erected in less time as there are no loose parts to be assembled. All that may be required is the actuation of one or more retraction mechanisms 110.

Figure 23:
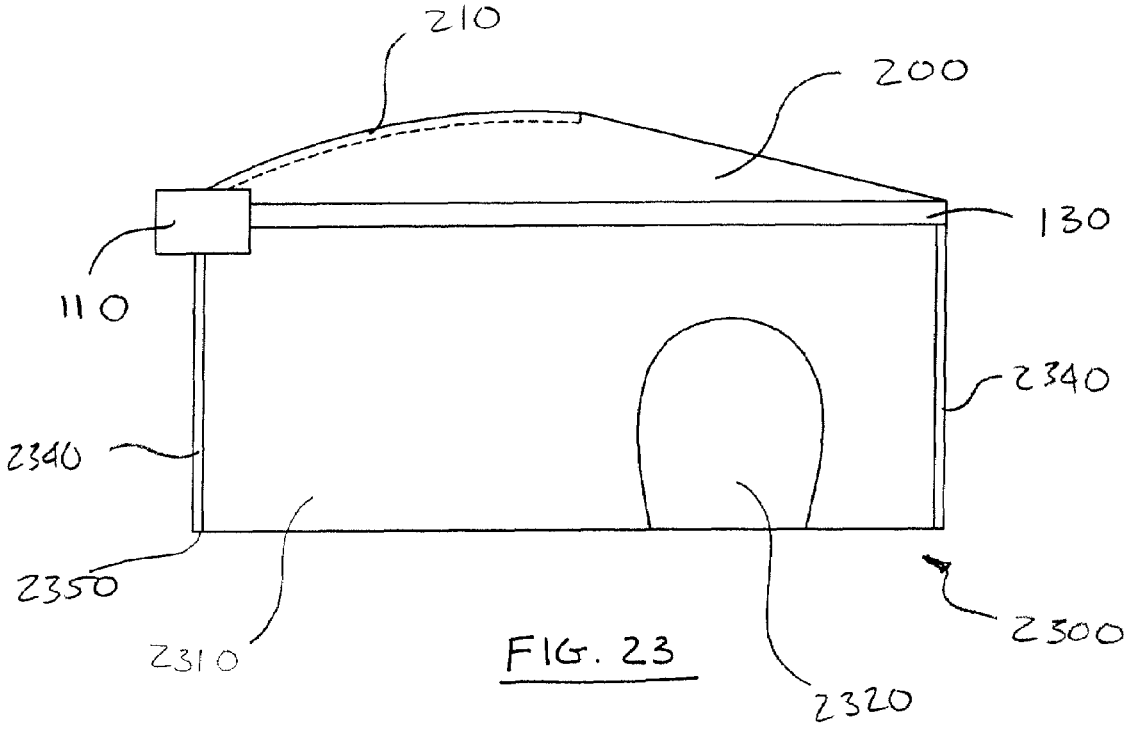
FIGS. 23-24 illustrate children's play structures incorporating features of an exemplary embodiment.

The support structures 200, 100 may also have additional components that form the vertical supports for the roof and the walls of the building structure 2300. As can be seen in FIG. 23, a support structure substantially similar to structure 220 is shown. In addition to the retraction mechanism 110, center support 210, compression frame 130 and canopy 200, as described above, the support structure may also include vertical supports 2340 and any suitable number of wall sections 2310. Any suitable number of vertical supports 2340 may be used. In this example three vertical supports 2340 may be located, for example, 120 degrees apart so as to form a stable base. In alternate embodiments, such as for example, when the compression frame forms a rectangular shape there may be four vertical supports located at each corner of the rectangular compression frame. The vertical supports 2430 may include any suitable number of compression members 120. The wall sections 2310 are substantially similar to the canopy 200 described above. The vertical supports may run through channels similar to channels 1620 or they may be attached to the wall section 2310 in any suitable manner. At least one wall section 2310 may be equipped with an opening or door 2320. The door may be any suitable door such as a flap of canopy material that can be, for example, zipped close. In alternate embodiments, the door 2320 may be closed in any suitable manner.

There may be a retraction mechanism 110 for each section of the building structure 2300 such as, for example, each vertical support 2340, the compression frame 130 and the center support 210 may each have their own retraction mechanism 110. The operation or forming of the structure 2300 is substantially similar to that described above with respect to FIGS. 1A-3B in that at least one tension member runs through the compression members 120 of the compression frame 130, each of the vertical supports 2340 and the center support 210. As each respective retraction mechanism 110 is actuated the tension members cause their respective compression members to come together in tight end-to-end contact. As the compression members come together they cause the canopy 200 and wall sections 2310 to open and become taut. In alternate embodiments, suitable anchoring devices such as, for example, stakes and loops may be provided on the free ends 2350 of the vertical supports 2340 so that the supports 2340 will not move once the structure 2300 is erected.

Figure 29A:
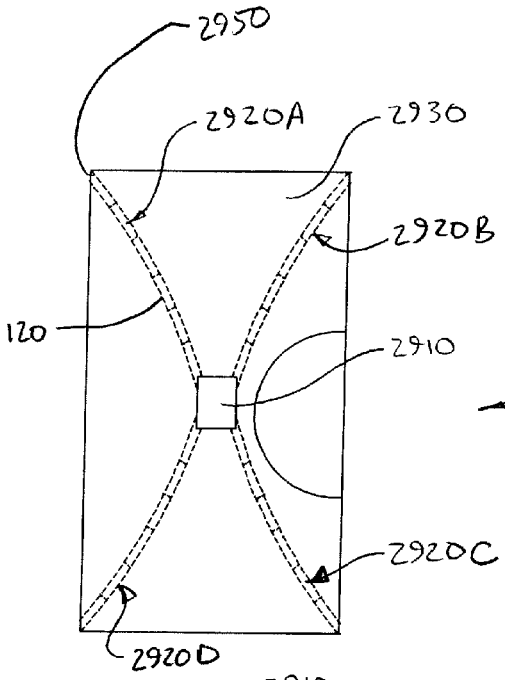
FIGS. 29A-C and 30A-C show structures in accordance with an exemplary embodiment.
Figure 29B:
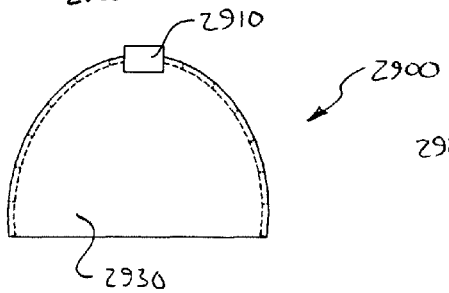
Figure 29C:
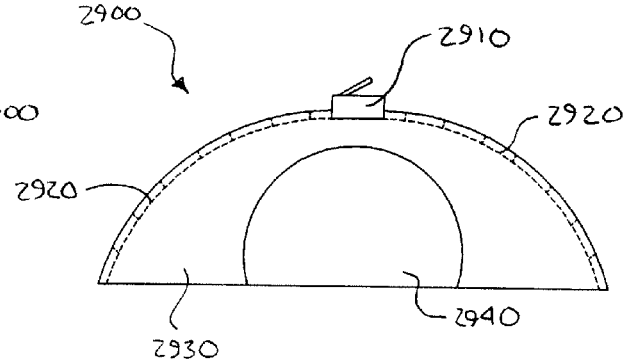

The support structure of the disclosed embodiments may also be used for other protective structures such as tents and the like. For example, the one or more open end frames such as that described above for FIG. 15A-15C may be employed as the frame of, for example, a protective structure as can be seen in FIGS. 29A-30C. Referring to FIGS. 29A-29C, a protective structure such as, for example, tent 2900 is shown. The tent generally includes frame members 2920A-D, a retraction mechanism 2910 and a protective barrier or walls 2930. The frame members 2920A-D may include any number of compression members 120. The frame members are attached to and depend from the retraction mechanism 2910 at one end. In this example, there are four frame members but in alternate embodiments there may be any suitable number of frame members. As described above with respect to FIGS. 15A-15C at least one tension member 1600 may run through an channel 1620 of each frame member 2920A-D where one end of the tension member 1600 terminates at the free end 2950 of each of the frame members 2920A-D while the other end of the tension member 1600 is connected to the retraction mechanism 2910. In this example the retraction mechanism is located at the top of the tent 2900 but in alternate embodiments the retraction mechanism may be located in any suitable area that may be easily reached by a user. The walls 2930 are substantially similar to the canopy 200 as described above and may be attached to the frame members 2920A-D via channels 1620 so that the frame members 2920A-D are located within a respective channel 1620. At least one wall may be provided with an opening or door 2940 that may be substantially similar to opening 2320 described above with respect to FIG. 23. In alternate embodiments, a floor may also be connected to the walls 2930 so as the structure is erected and the frame members expand, the flexible material of the floor is also opened.

In operation a user actuates the retraction mechanism which causes the tightening of the tension member 1600 and ultimately the end-to-end contact of the compression members 120 of the frame members 2920A-D. As the frame members extend to a rigid state the walls 2930 are opened and held taught between the frame members 2920A-D. In alternate embodiments, suitable anchoring devices such as, for example, stakes and loops may be provided on the free ends 2950 of the frame members 2920A-D so that the members 2920A-D will not move once the structure 2900 is erected. To assist in opening the structure 2900 at least one elastic member which may be substantially similar to the pre-tension elastic member 1610 may be included and run through the channel 1620 of the compression members 120 of the frame so that when the structure is ready to be erected the elastic member springs the structure into its general shape.

Figure 30A:
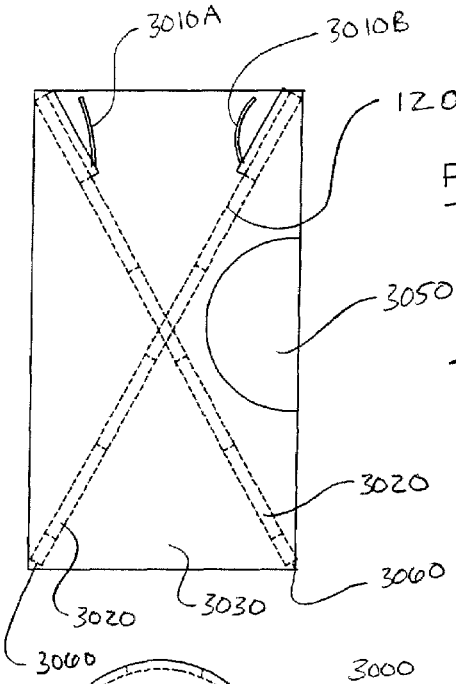
Figure 30B:
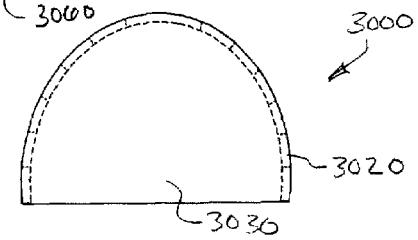
Figure 30C:
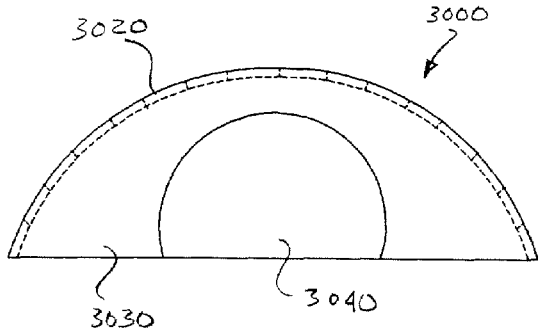
Figure 31A:
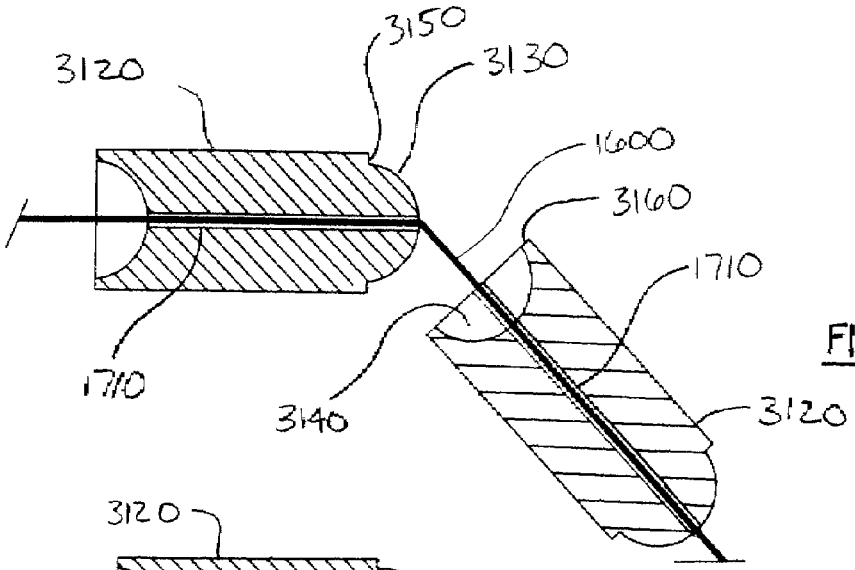
FIGS. 31A-D illustrate a cross-sectional view of an assembly of compression members in accordance with an exemplary embodiment.
Figure 31B:
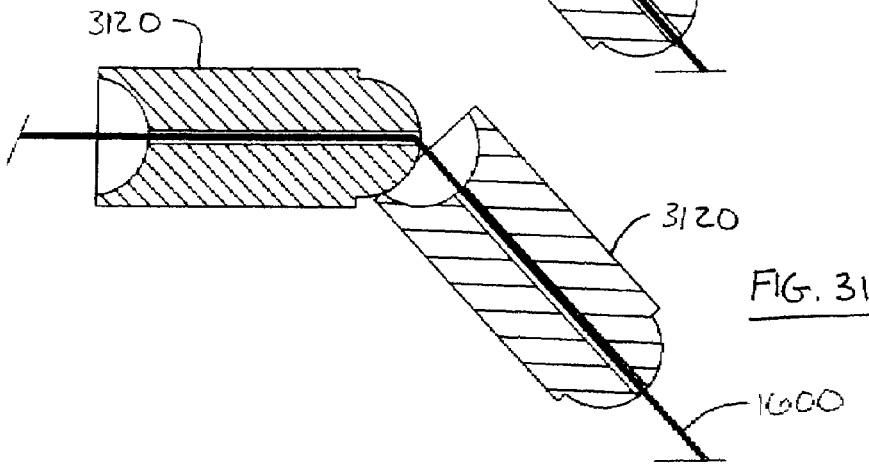
Figure 31C:
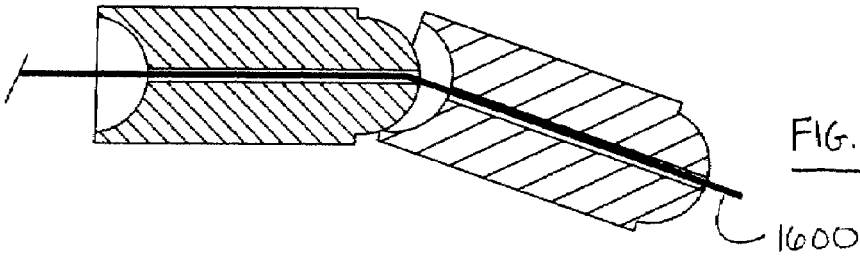
Figure 31D:
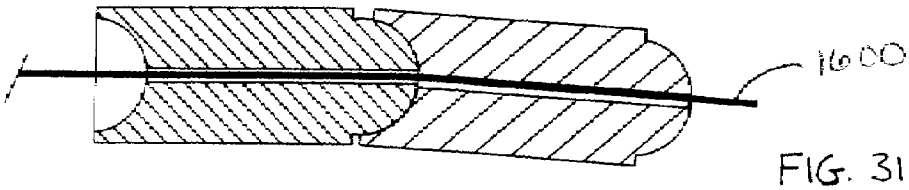

FIGS. 30A-C show a protective structure or tent 3000. In this example, the structure 3000 generally includes two frame support members 3020 where each frame support member 3020 includes a retraction mechanism 3010A, 3010B. Although two frame support members 3020 are shown, in alternate embodiments any suitable number of frame support members may be utilized. The frame support members include any number of compression members 120 and may be inserted into a channel 1620 of the flexible material 3030. A tension member 1600 may run through the compression members 120 of each of the frame support members 3020. The tension member 1600 may be attached to the retraction mechanism 3010A, 3010B at one end and terminate at the opposite end 3060 of the frame support member 3020. The flexible material is substantially similar to canopy 200 described above. The flexible material may also be provided with an opening or door 3050 that may be substantially similar to opening 2320 described above with respect to FIG. 23. The retraction mechanisms 3010A, 3010B may be substantially similar to the retraction mechanism 110 and are shown at being located at an end of the frame support members 3020. In alternate embodiments the ratcheting mechanisms 3010A, 3010B may be located in any suitable location on the frame support members.

In operation one or more users may actuate the retraction mechanisms 3010A, 3010B which causes the tightening of their respective tension member 1600 and ultimately the end-to-end contact of the compression members 120 of the frame support members 3020. As the frame support members 3020 extend to a rigid state the flexible material 3030 is opened and held taught between the frame members 3020. AS can be seen in FIGS. 30A-30C the flexible material 3030 may form the walls of the structure 3000. In alternate embodiments, the flexible material 3030 may also include a floor portion that is attached to the walls to form a structure that can be sealed from the environment. In other alternate embodiments, suitable anchoring devices such as, for example, stakes and loops may be provided on the ends of the frame support members 3020 so that the members 3020 will not move once the structure 3000 is erected. As described above with respect to FIGS. 29A-29C, the structure 3000 may be provided with an elastic member that runs through the frame support members 3020 to assist in the erection of the structure 3000.

Figure 33A:
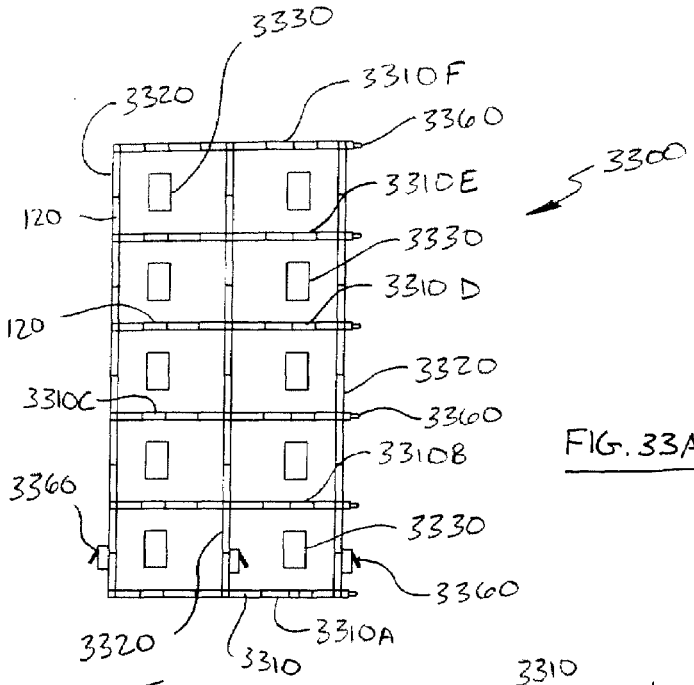
FIGS. 33A-D illustrate a shelter in accordance with exemplary embodiments.
Figure 33B:
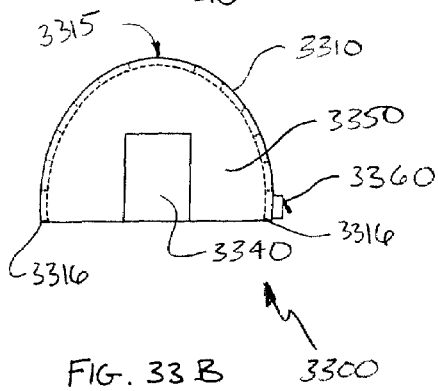
Figure 33C:
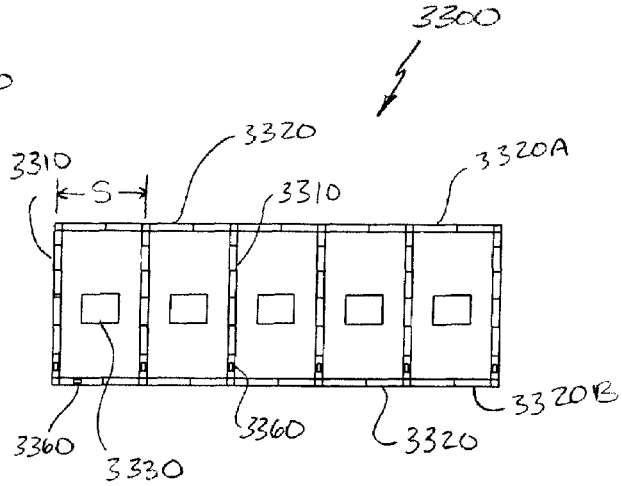

Referring to FIGS. 33A-33C, another exemplary embodiment of a shelter 3300 is shown. The shelter 3300 may include any suitable number of arched members 3310, any suitable number of longitudinal straight members 3320, retraction devices 3360 and a flexible fabric 3350. The shelter 3300 may be of any suitable length width and height to accommodate, for example, people, vehicles, aircraft or any other suitable object. The shelter 3300 may also be provided with snaps, hooks, zippers, or any other suitable attachment mechanism so that one shelter 3300 may be connected end to end with another shelter 3300.

The straight members may include any suitable number of compression members 120 held together by a tension member 1600. The arched members 3310 may include any suitable number of compression members 120 held together by a tension member 1600. Each of the arched members 3310 and the straight members 3320 may have their own separate tension members 1600 that may be tightened by a respective retraction device 3360 as shown in FIGS. 33A-33C. In alternate embodiments, there may be a single tension member 1600 running through the straight and arched members. In other alternate embodiments, there may be any suitable number of tension members running through the arched and straight sections in any suitable configuration.

Figure 33D:
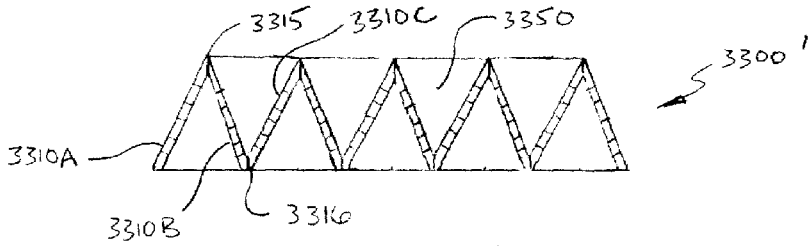

The straight members 3320 may provide for any suitable spacing S between the arched members 3310 and may be connected to the arched members 3310 so that the straight members 3320 provide support for holding the arched members 3310 in an upright position as shown in FIG. 33B. For example, the straight member 3320A may be connected to the tops or peaks of the arched members 3310A-3310F while the straight members 3320B are connected to the legs or bottoms 3316 of the arched members 3310A-3310F. In alternate embodiments, the straight members may be omitted in that the arched members may be connected to each other in an alternating manner. For example, the peak 3315 of arched members 3310A and 3310B may be joined while the legs 3316 of arched members 3310B and 3310C are joined and so on to form a shelter 3300' as shown in FIG. 33D.

The arched members 3310 and the straight members 3320 may pass through a channel in a flexible fabric 3350 that spans between the arched and straight members. The channel in fabric 3350 may be substantially similar to the channel 1620 shown in FIG. 16. The flexible material may be any suitable material such as, for example, nylon or and may be provided with any suitable number of openings such as opening 3340 that may provide access into and out of the shelter 3300. The fabric may also be provided with any suitable number of windows 3330 as shown in FIGS. 33A-33C. The opening 3340 and windows 3330 may be provided with a flap or other suitable membrane that may be affixed to the opening 3340 or window 3330, such as by snaps or zippers, to prevent unwanted access into the shelter. In alternate embodiments the flaps or membranes may be affixed to the fabric 3350 in any suitable manner such as by sewing the membrane to the fabric. In alternate embodiments, the flaps or membranes may be made of any suitable material such as, for example, the same material as the fabric 3350 or they may be a different material. In other alternate embodiments the flaps or membranes may be a translucent or transparent material.

In operation, one or more users may, for example, manually or electronically actuate the retraction devices 3360 of the shelter 3300 to retract the tension members 1600 so that the compression members 120 of the arched and straight members 3310, 3320 are respectively brought into tight end-to-end contact. As the compression members 120 are brought into tight end-to-end contact the fabric 3350 may be stretched and held taught between the arched and straight members 3310, 3320. The fabric 3350 may also constrain the arched members 3310 into their arched shape. The shelter 3300 may provide a large interior space without any obstructions from support poles. In alternate embodiments, interior walls may be provided to create separate rooms or partitions within the shelter 3300. The walls may be attached to the arched members 3310 and be constructed of the fabric 3350 or any other suitable fabric. In other alternate embodiments, a floor may also be provided in the shelter 3300.

The protective structures of FIGS. 21-23, 29A-30C and 33A-33C may be utilized for applications such as, for example, camping tents, emergency structures, evacuation shelters, refugee shelter, first aid/triage shelters, field offices and/or children's play structures. The structures may also be adapted for extraterrestrial use. The building structures, tents and shelters disclosed herein may be stored in small containers such as back packs and duffel bags and may be easily transported by car or truck or dropped as a bundle from an aircraft into, for example, remote areas. Building structures, tents and shelters in accordance with the exemplary embodiments may be advantageous in that there are no loose parts that can be lost or misplaced and the structures can be quickly erected by a minimum number of people with no need for instructions. For example, in an emergency situation where there is limited manpower and many distractions, a user may not have time to read and understand assembly instructions. In addition, the rapid deployment and erection of the exemplary shelters may provide the maximum number of safe shelters to save lives.

Figure 24:
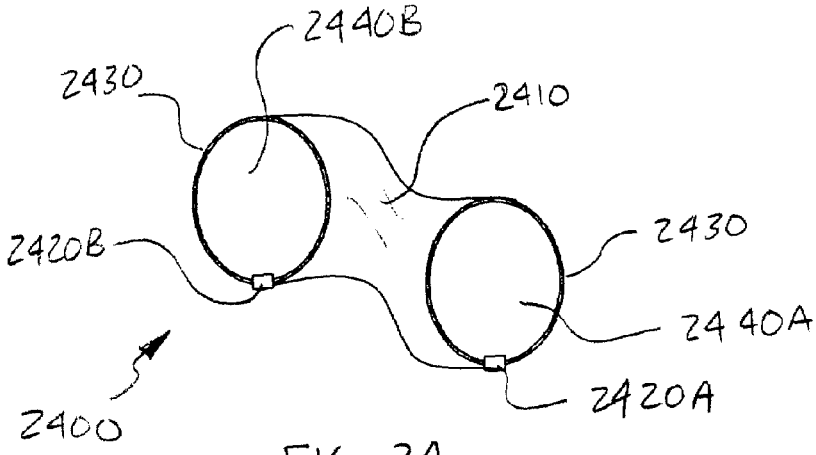

The compression ring of the exemplary embodiments may also be employed in a child's play apparatus such as that shown in FIG. 24. FIG. 24 illustrates a tubular play structure 2400 that children may crawl through. The structure 2400 generally includes at least two compression rings 2430 each having a retraction mechanism 2420A, 2420B. The compression rings 2430 may be connected by a flexible material 2410 so that a tube is formed having openings 2440A, 2440B. The compression rings 2430 and retraction mechanisms 2420A, 2420 B may be substantially similar to the compression ring 130 and retraction mechanism 110 described above. The flexible material may be any suitable material such as, for example, nylon or polyester. The tubular structure 2400 may have any suitable length and diameter.

In operation a user may actuate each of the retraction mechanisms 2420A, 2420B so the compression rings 2430 are formed in a manner substantially similar to that described above with respect to FIGS. 1A and 1B. The compression rings 2430 may be supported in any suitable manner so that they are held in a vertical position so that children or animals, such as dogs, may crawl, run, walk or otherwise move through the tubular structure 2400.

Figure 25A:
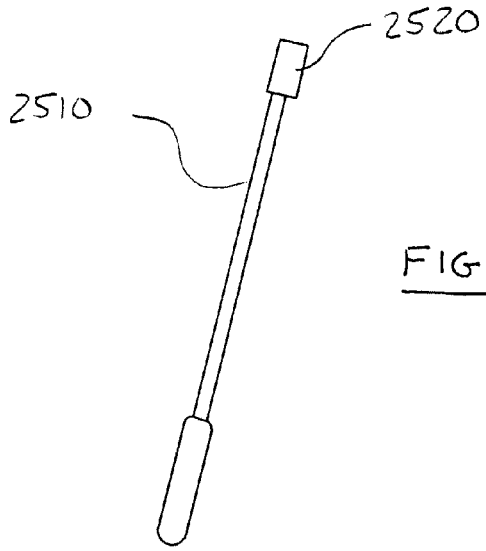
FIGS. 25A-C illustrate sporting equipment incorporating features of an exemplary embodiment.
Figure 25B:
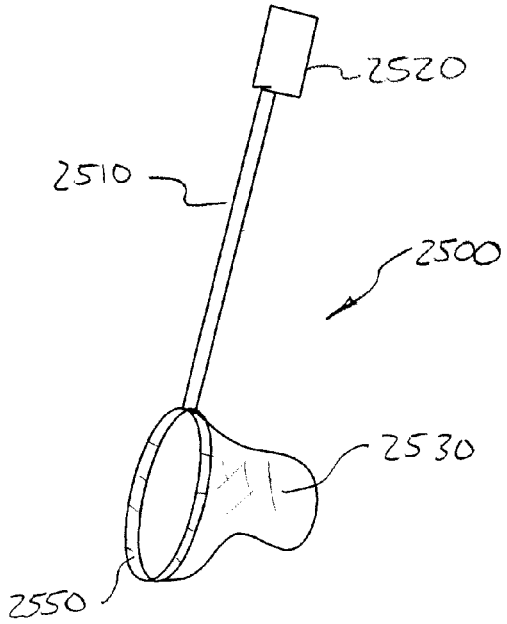
Figure 25C:
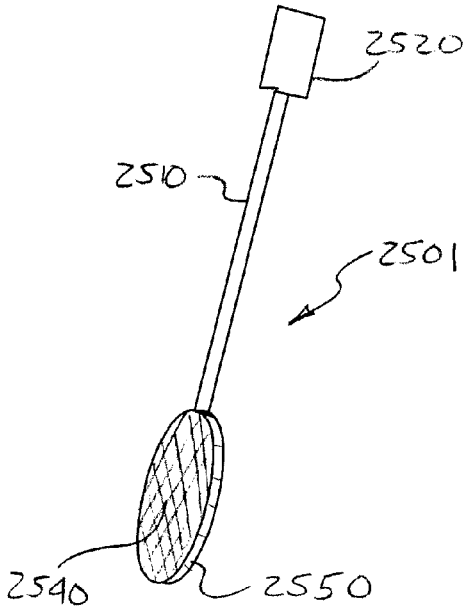

The exemplary embodiments may also be applied to sports activities or hobbies such as fishing, badminton, Ping-Pong and the like. Referring now to FIGS. 25A-25C a net 2500 and a racket 2501 are shown. These devices generally include a retraction mechanism 2520, a pole support 2510, and a compression frame 2550. The retraction mechanism 2520 is connected to one end of the pole support 2510 and may be substantially similar to retraction mechanism 110. In alternate embodiments, the retraction mechanism may be incorporated in the pole support such as the telescopic pole 1000 of FIGS. 10A and 10B. The pole support 2510 in this example is shown as a one piece member such as a hollow shaft of any suitable material. In alternate embodiments the pole support 2510 may include any suitable number of compression members 120 in a manner substantially similar to that described above for 3A and 3B. The compression frame 2550 is attached to one end of the pole support 2510 and may be substantially similar to compression frame 130. The fishing net 2530 and the racket strings 2540 may be attached to the compression frame 2550 in any suitable manner so that when a user actuates the retraction mechanism and tightens the tension member 1600 to form the compression frame 2550 the net 2530 and strings 2540 remain oriented around the perimeter of the compression frame 2550.

The compression ring of the exemplary embodiments may also be utilized in medical applications such as for blocking the lumen of an internal organ or vessel such as an intestinal tract or artery. The exemplary embodiments may be utilized for the retraction of organs or to make room around a surgical site and may be used where access to the work area is limited such as, for example, with minimally intrusive surgery or intra-luminal surgery.

Figure 27A:
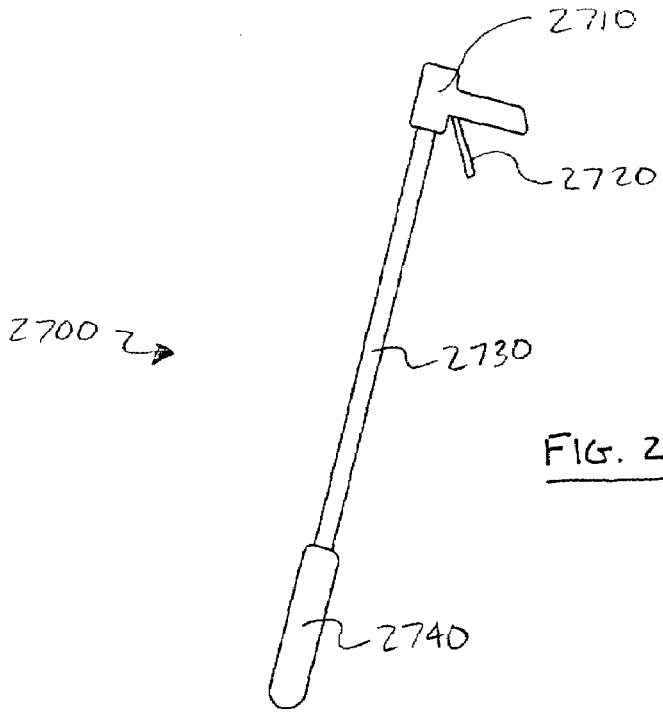
FIGS. 27A-F illustrate surgical instruments incorporating features of an exemplary embodiment.
Figure 27B:
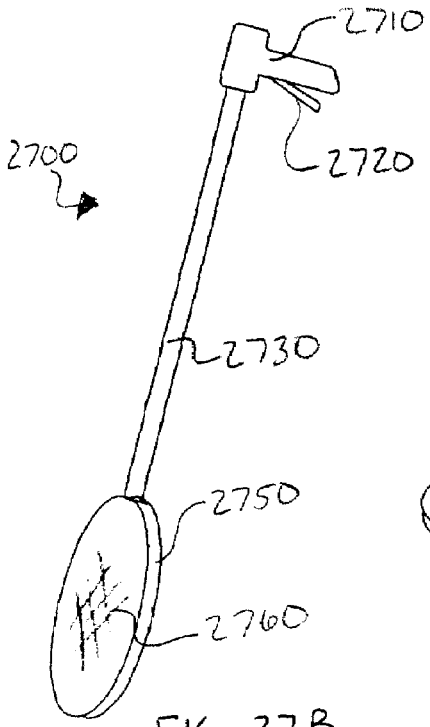
Figure 27C:
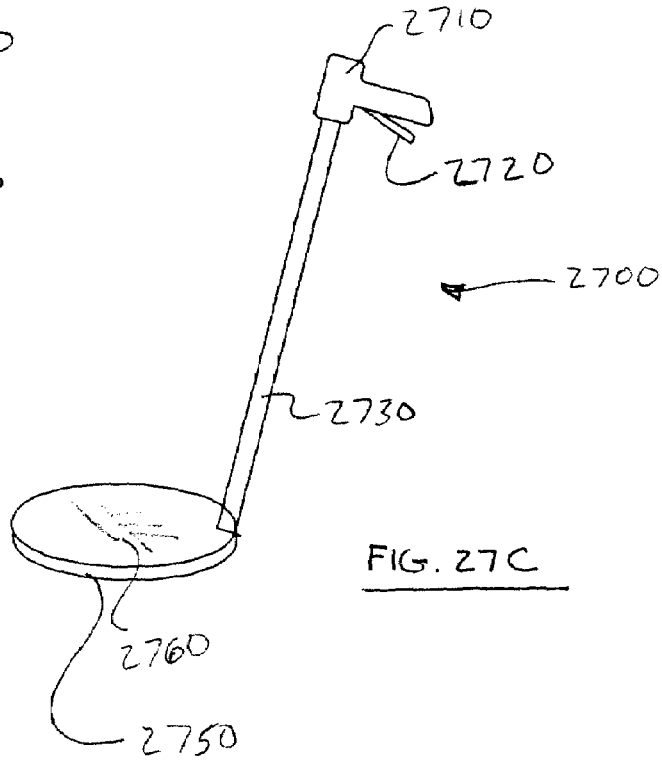

For example, as can be seen in FIGS. 27A-27C, a paddle manipulator 2700 is shown. The manipulator 2700 generally includes a retraction handle 2710 that is configured for surgical use, a retraction actuator 2720, a pole support 2730, a compression frame 2750 and a membrane 2760. The retraction handle 2710 and actuator 2720 operate in a substantially similar manner to retraction mechanism 110 described above.

The pole support 2730 is attached to the handle 2710 and in this example is shown as a one piece member such as a hollow shaft of any suitable material capable of being sterilized. In alternate embodiments the pole support 2730 may include any suitable number of compression members 120 in a manner substantially similar to that described above for 3A and 3B. The compression frame 2750 is attached to an end of the pole support 2730.

The compression frame 2750 may be substantially similar to frame 130. As can be seen in FIGS. 27B and 27C the compression frame 2750 may be attached to the pole support 2730 so that the compression frame is parallel with or perpendicular to the pole support 2730. In alternate embodiments the compression frame 2750 may be attached to the pole support 2730 at any suitable angle. In other alternate embodiments the compression frame 2750 may pivot on the pole support 2730 so that a surgeon may control the angle of the compression frame 2750 via an angle control mechanism located on, for example the handle 2710. The membrane 2760 may be a flexible material such as rubber or latex that is capable of being sterilized. The membrane may be attached to the compression frame through a channel similar to channel 1620 through which the members of the compression frame pass. Because this device is being applied to surgical application, the components of the manipulator 2700 should be capable of being sterilized.

In operation a user may insert the manipulator 2700 when the compression frame 2750 is in a collapsed state 2740. The actuator on the handle 2710 may be manipulated causing a tension member 1600, that runs from the retraction mechanism within the handle 2710 through the pole support 2730 and into the compression frame 2750, to retract thereby causing the compression members 120 of the compression frame 2750 to come together in tight end-to-end contact. As the compression members 120 come together the flexible membrane 2760 is stretched. The stretched membrane 2760 may be applied to manipulate any suitable item during surgery.

Figure 27D:
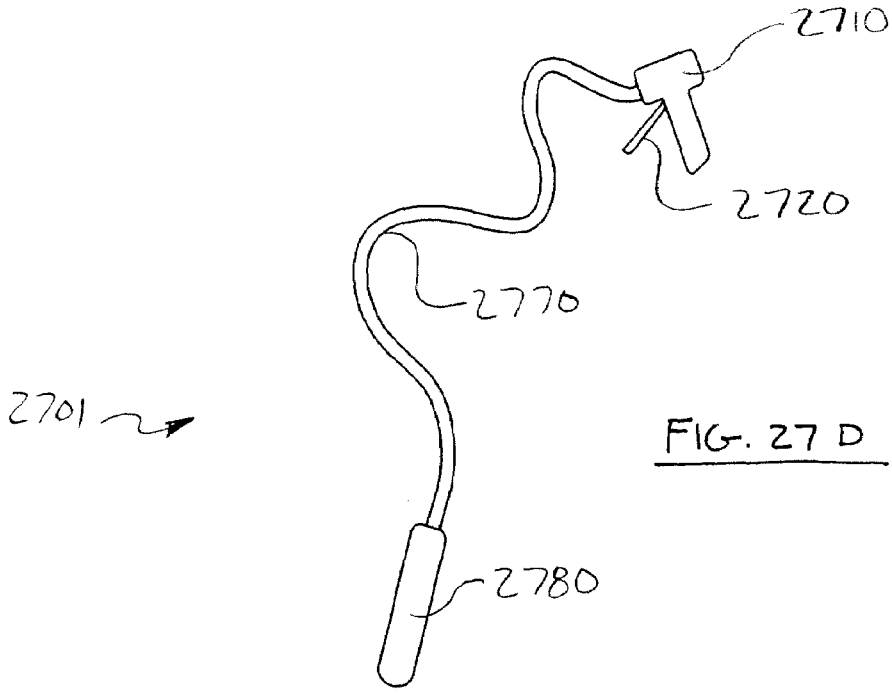
Figure 27E:
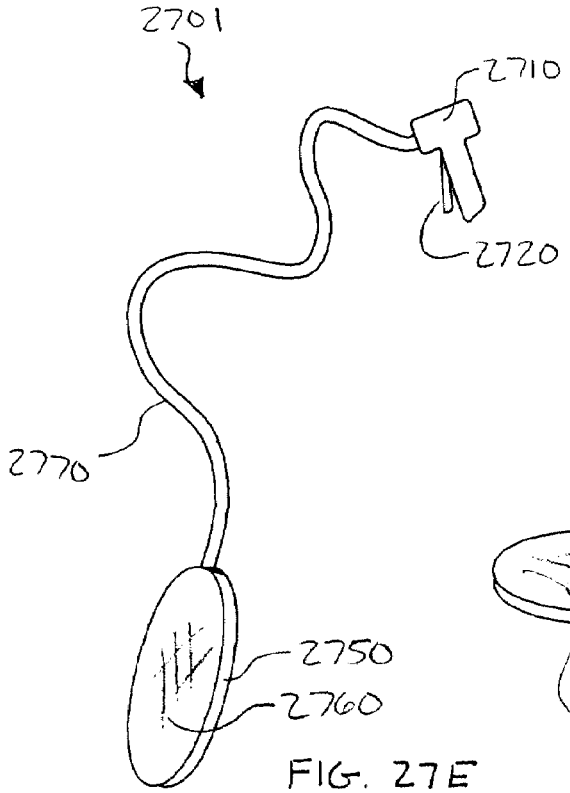
Figure 27F:
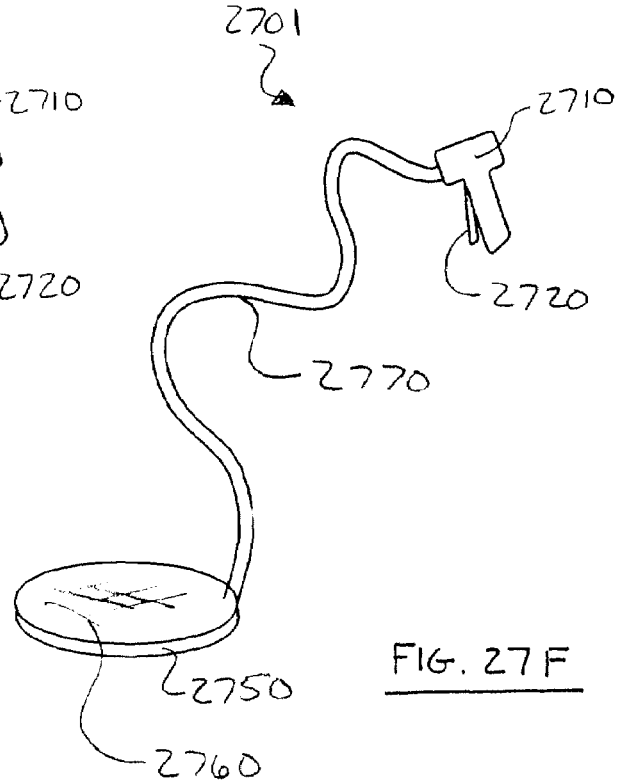

FIGS. 27D-27F show a manipulator 2701 that is substantially similar to manipulator 2700. However, manipulator 2701 is provided with a flexible pole support 2770. The flexible pole support 2770 may be constructed of any suitable flexible material. In alternate embodiments, the flexible pole support 2770 may include any suitable number of compression members 120 that may be brought together in tight end-to-end contact by a second retraction mechanism located in any suitable location of the manipulator 2701 such as on the handle 2710.

Figures 28A, 28B, 28C:
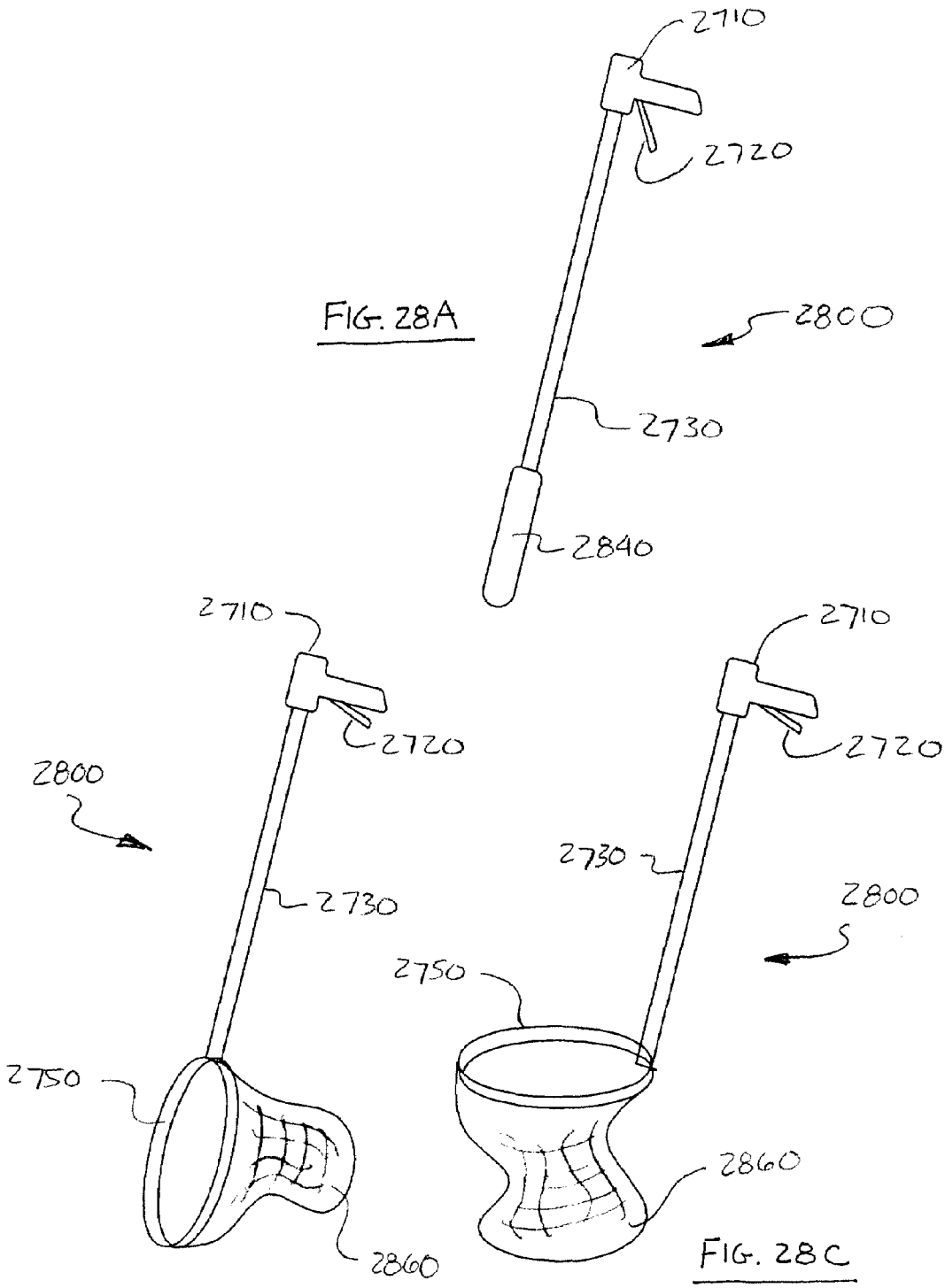
FIGS. 28A-C illustrate a surgical instrument in incorporating features of an exemplary embodiment.

FIGS. 28A-28C show a surgical net 2800 that may be substantially similar to the manipulator 2700 however, instead of membrane 2760 the net 2800 includes a net 2860 for catching or retrieving items during surgery. In alternate embodiments, the net 2800 may have a flexible pole support such as that described above for FIGS. 27D-27F. The net 2860 may be made of any suitable material such as rubber, latex, cloth, and the like. The net material may be, for example, a mesh of any suitable size so that fluids and objects smaller than the mesh may pass through the net 2860. In alternate embodiments, the net material may be solid so as to prevent fluids and objects from passing through. The net may also have any suitable characteristics such as flexible or elastic characteristics.

During surgery the net 2800 may operate in a substantially similar manner as the manipulators 2700, 2701 in that it is inserted to the working area when the net is in a closed state 2840 and opened with the actuator 2720 and retraction mechanism 2710. The net may be used to retrieve objects during surgery. If necessary, once an object has been captured by the net 2800 the retraction mechanism 2710 may be released causing the compression frame 2750 and net to close as so as to retain the object from escaping from the net.

Figure 26A:
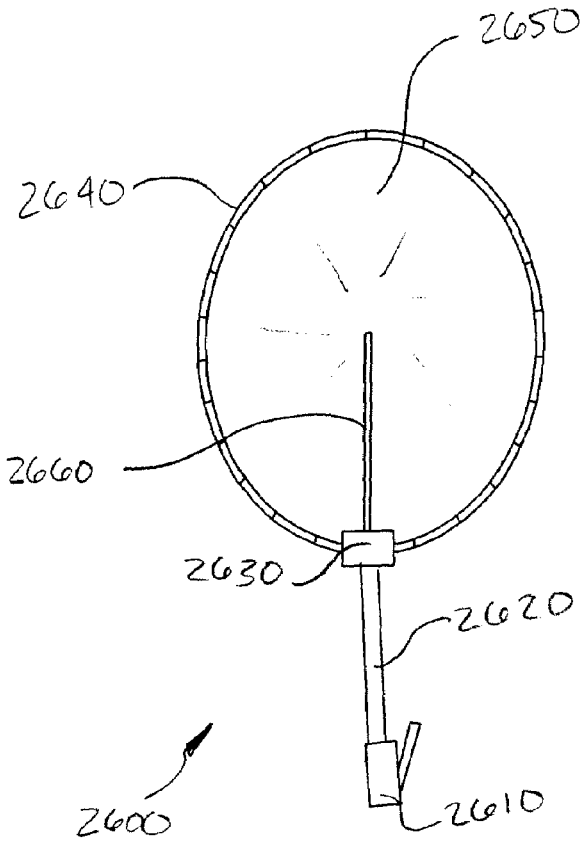
FIGS. 26A-B illustrate photographic equipment incorporating features of an exemplary embodiment.
Figure 26B:
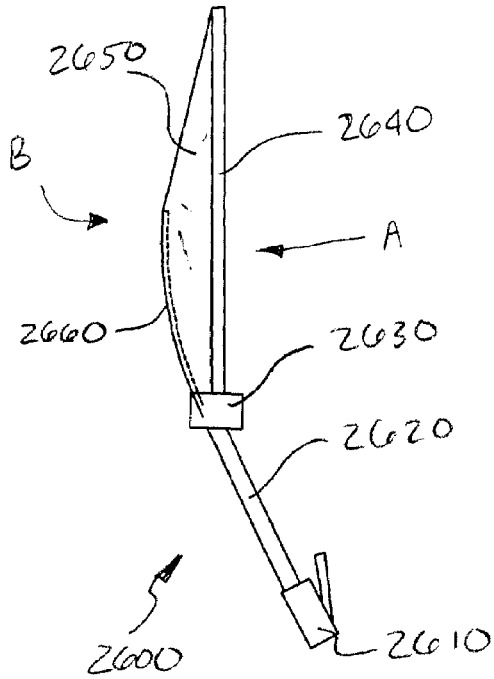

Referring now to FIGS. 26A and 26B, a photography lighting control device 2600 incorporating features of an exemplary embodiment is shown. The lighting control device 2600 generally includes a retraction mechanism 2610, a pole support 2620, a hub 2630, a compression frame 2640, and a flexible material portion 2650. In this example the device 2600 is also shown having a center support 2660. In alternate embodiments the device 2600 may not include the center support. The retraction mechanism 2610, the pole support 2620, the hub 2630, the center support 2660 and the compression frame 2640 may be substantially similar to that described above with respect to FIGS. 3A-3B and 6A-6C. In alternate embodiments the pole support 2620 and retraction mechanism 2610 may be combined into a telescopic pole such as that described above with respect to FIGS. 10A and 10B.

The pole support 2620 is attached at one end to the retraction mechanism 2610 and attached at the other end to the hub 2630. In alternate embodiments, the retraction mechanism may be located at any suitable location on the device 2600. The pole support 2620 may be attached to the hub 2630 at any suitable angle. In alternate embodiments the hub may provide a pivot point so a user may adjust the angle of the compression frame 2640 with respect to the pole support. The center support 2660 and the compression frame 2640 are also attached to and depend from the hub 2630. The center support may be attached to the hub at any suitable angle to produce the convex shape of the light reflecting/diffusing surface formed by the material portion 2650. In alternate embodiments, the center support 2660 may be attached to the hub 2630 via an adjustable pivoting mount so a user may adjust the shape of the light reflecting/diffusing surface of the device 2600. The flexible material portion 2650 may be any suitable material capable of reflecting and/or diffusing light. The material portion 2650 may be configured so that both sides of the material are reflective so that when the concave side A of the device 2600 faces the light, the light is concentrated according to the focal point of the concave shape and when the light faces the convex side B of the device 2600 the light is diffused. In alternate embodiments, only one side the material 2650 may be reflective. In other embodiments, the material may have light absorbing properties to prevent the reflection of light.

The light reflecting/diffusing device 2600 may be provided with any suitable stand where, for example, the pole support 2620 is placed in the stand to hold the device 2600 in a vertical position. In alternate embodiments the stand may allow the device 2600 to be held at any suitable angle. In other embodiments, a folding tripod, for example, may be incorporated into the pole support 2620.

It should be understood that the individual components of the exemplary embodiments may be used in any suitable combination to form a personal protective device, recreational device or protective structure. The exemplary embodiments described herein provide protection and recreational devices that do not have any protruding exterior points and are not complex in their design. When used in an outside environment, as is the case for an umbrella or support structure, the exemplary embodiments are less likely to be struck by lightening because there are no points that would cause a concentration of an electrical charge. A greater useable area is also provided by the disclosed embodiments in that there is no center support pole that would obstruct a user from taking shelter in the center of the protective device, such as those shown in FIGS. 3B and 6B. The exemplary embodiments also provide protective and recreational devices that can be erected quickly and do not have any loose parts that may be lost by a user. The exemplary embodiments may also be stored in as a compact unit due to their foldable nature.

It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

What is claimed is:

1. A collapsible device comprising:

at least one retraction device;

at least one collapsible compression frame having compression members, the at least one collapsible compression frame depending from the at least one retraction device when the compression members are in end-to-end contact;

at least one tension member having at least one end coupled to the at least one retraction device and running through a channel in each of the compression members; and a flexible barrier attached to the at least one compression frame, the barrier having at least one channel through which the at least one compression frame passes.

2. The device of claim 1, wherein the at least one retraction device causes a tightening of the at least one tension member, the tightening of the at least one tension member causes the compression members of the at least one compression frame to come together in end-to-end contact, the coming together of the compression members causes the barrier to be stretched taut by the compression frame.

3. The device of claim 1, further comprising at least one barrier support depending from the at least one compression frame for supporting a center portion of the barrier.

4. The device of claim 1, further comprising at least one pre-tension elastic member running through the channel in the each of the compression members.

5. The device of claim 1, further comprising at least one pole support connected to the at least one compression frame.

6. The device of claim 5, wherein the at least one pole support is a collapsible pole support comprising compression members where the at least one tension member passes through channels in each of the compression members.

7. The device of claim 5, wherein the retraction mechanism is located on the compression frame or the at least one pole support.

8. The device of claim 5, wherein the at least one pole support is connected to the at least one compression frame at an angle.

9. The device of claim 5, wherein the barrier comprises at least one side portion that extends from the at least one compression frame to a free end of the at least one pole support, the at least one side portion having at least one opening for passage through the at least one side portion.

10. The device of claim 1, further comprising at least one barrier position assist member connected at one end to a perimeter of the barrier for pulling the barrier over the at least one compression frame during opening of the device.

11. The device of claim 1, wherein the at least one retraction device comprises a telescopic member connected to the at least one compression frame, wherein extension of the telescopic member causes a tightening of the at least one tension member.

12. The device of claim 1, wherein the barrier includes an upper portion and a lower portion, the upper portion having at least one channel for the at least one compression frame to pass through, the upper and lower portions of the barrier forming a sealed cavity, the upper portion having an opening for passage into and out of the cavity.

13. The device of claim 1, wherein there are two compression frames and the barrier forms a tube between the two compression frames.

14. The device of claim 1, wherein the barrier has a display message or advertisement affixed to a surface of the barrier.

15. The device of claim 1, wherein the at least one collapsible compression frame includes at least one arched compression frame and at least one straight compression frame where one of the at least one straight compression frame is connected to the at least one arched compression frame at a peak or a leg.

* * * * *